US009208972B2

(12) United States Patent
Matsumoto

(10) Patent No.: US 9,208,972 B2
(45) Date of Patent: Dec. 8, 2015

(54) SLIDE FASTENERS

(71) Applicant: Masaki Matsumoto, Kuwana (JP)

(72) Inventor: Masaki Matsumoto, Kuwana (JP)

( * ) Notice: Subject to any disclaimer, the term of this patent is extended or adjusted under 35 U.S.C. 154(b) by 0 days.

(21) Appl. No.: 14/353,237

(22) PCT Filed: Oct. 9, 2012

(86) PCT No.: PCT/JP2012/006454
§ 371 (c)(1),
(2) Date: Apr. 21, 2014

(87) PCT Pub. No.: WO2013/061524
PCT Pub. Date: May 2, 2013

(65) Prior Publication Data

US 2014/0251771 A1 Sep. 11, 2014

(30) Foreign Application Priority Data

Oct. 27, 2011 (JP) ..... 2011-235714

(51) Int. Cl.

| | |
|---|---|
| ***H01R 25/00*** | (2006.01) |
| ***H01H 15/00*** | (2006.01) |
| ***H01R 13/28*** | (2006.01) |
| ***A44B 19/24*** | (2006.01) |
| *F21S 2/00* | (2006.01) |

(52) U.S. Cl.
CPC ..... *H01H 15/00* (2013.01); *A44B 19/24* (2013.01); *H01R 13/28* (2013.01); *F21S 2/00* (2013.01)

(58) Field of Classification Search
CPC ..... H01R 25/142; H01R 25/14
USPC ..... 439/121, 122, 110
See application file for complete search history.

(56) References Cited

U.S. PATENT DOCUMENTS 4,676,567 A * 6/1987 Mouchi ..... 439/207
5,499,927 A 3/1996 Ohno et al.

(Continued)

FOREIGN PATENT DOCUMENTS

JP 05-335045 A 12/1993
JP 06-333648 A 12/1994

(Continued)

OTHER PUBLICATIONS

International Search Report for PCT/JP2012/006454, Mailing Date of Dec. 18, 2012.

(Continued)

*Primary Examiner* — Phuongchi T Nguyen
(74) *Attorney, Agent, or Firm* — Westerman, Hattori, Daniels & Adrian, LLP

(57) ABSTRACT

A slide fastener includes rows of elements arranged so as to face one another along edges of opening-closing ends of opposing fastener tapes; and a slider. The slide fastener can be interposed between a powered device on an output side and a power supply unit and a signal unit on an input side so as to form an input-output line that activates the powered device with a closing operation of the slide fastener. The elements form a top holding section by bringing ends of element-upper-leg portions arranged so as to face one another closer to or away from one another; and a bottom holding section by bringing ends of element-lower-leg portions arranged to face one another closer to or away from one another in cooperation with interlock or separation of the interlock portions of the elements arranged to face one another, which form part of the input-output line.

20 Claims, 19 Drawing Sheets

(56) References Cited

U.S. PATENT DOCUMENTS

| | | | | |
|---|---|---|---|---|
| 5,855,485 | A * | 1/1999 | Patti | 439/121 |
| 6,033,239 | A * | 3/2000 | Jaakkola et al. | 439/121 |
| 6,616,465 | B1 * | 9/2003 | Fontana et al. | 439/110 |
| 7,507,005 | B1 * | 3/2009 | Mier-Langner | 362/418 |
| 7,520,763 | B1 * | 4/2009 | Buse | 439/121 |

FOREIGN PATENT DOCUMENTS

| | | | |
|---|---|---|---|
| JP | 07-192522 | A | 7/1995 |
| JP | 2005-347173 | A | 12/2005 |
| WO | 2005/101582 | A1 | 10/2005 |
| WO | 2010/065599 | A1 | 6/2010 |
| WO | 2011/004563 | A1 | 1/2011 |
| WO | 2011/004564 | A1 | 1/2011 |
| WO | 2011/058696 | A | 5/2011 |

OTHER PUBLICATIONS

Extended European Search Report dated Jun. 25, 2015, issued in counterpart Patent Application No. 12842882.8 (12 pages).

* cited by examiner (a)

(b)

I : INPUT
O : OUTPUT
C : COUPLER (a)

(b)

(a)

(b)

SLIDE FASTENERS

TECHNICAL FIELD

The present invention relates to a slide fastener that is interposed between a powered device on an output side and a power supply unit and a signal unit on an input side and that forms an input-output line that activates the powered device by a closing operation of the slide fastener.

BACKGROUND ART

As an existing method for attaching a lighting device to a ceiling, a wall, or the like, lighting apparatuses are known in which a lighting device is directly hung from a ceiling, a wall, or the like or in which a ceiling plug is slidably mounted on a rail provided on a ceiling and a lighting device is hung from the ceiling plug (PTL 1). Meanwhile, a flexible connector having a slide fastener structure is known in which elements arranged side by side on edge portions of two tapes are engaged with each other as a result of movement of a slider to join the tapes together using the characteristics of a slide fastener (PTL 2).

CITATION LIST

Patent Literature

PTL 1: Japanese Unexamined Patent Application Publication No. 07-192522

PTL 2: Japanese Unexamined Patent Application Publication No. 2005-347173

In the lighting apparatus described in PTL 1, however, the lighting device is movable but only within the range of the fixed rail. Moreover, the apparatus requires an installation surface for fixing the rail. The flexible connector described in PTL 2, on the other hand, is suitable for a planar form in which the tapes are coupled together to be used as electric wiring. However, it has been difficult to develop this form into an idea of three-dimensionally forming an input-output line that activates the powered device into a stacked structure.

An object of the present invention is to provide a slide fastener that has uniquely shaped elements created by means of a new idea, that is interposed between a powered device on an output side and a power supply unit and a signal unit on an input side, and that forms an input-output line that activates a powered device by a closing operation of the slide fastener via an input electrode section and an output electrode section, the input electrode section connecting the power supply unit and the signal unit on the input side to the input side of the slide fastener, the output electrode section connecting the powered device on the output side to the output side of the slide fastener.

SUMMARY OF THE INVENTION

To achieve the above object, a slide fastener according to a first embodiment of the invention is a slide fastener that is interposed between a powered device on an output side and a power supply unit and a signal unit on an input side, the slide fastener forming an input-output line that activates the powered device with a closing operation of the slide fastener, the slide fastener comprising: rows of elements arranged so as to face one another along edges of opening-closing ends of opposing fastener tapes; and a slider. Each of the elements includes: an interlock portion provided on a first side in a horizontal direction; a fastener-tape fixing portion provided on a second side in the horizontal direction; and an element-upper-leg portion and an element-lower-leg portion that extend in vertical upward and downward directions with respect to the horizontal direction, a portion of the element-upper-leg portion extended in the vertical upward direction being bent into a hook shape, and a portion of the element-lower-leg portion extended in the vertical downward direction being bent into a hook shape. The elements are arranged so as to face one another and form a top holding section by bringing ends of the element-upper-leg portions arranged so as to face one another closer to or away from one another and form a bottom holding section by bringing ends of the element-lower-leg portions arranged so as to face one another closer to or away from one another in cooperation with interlock or separation of the interlock portions of the elements arranged so as to face one another. When the element-upper-leg portion and the element-lower-leg portion of the slide fastener are made of a nonelastic material, by sliding the slider along the elements arranged so as to face one another, the elements are interlocked to close opening-closing ends in the horizontal direction, which are the opposing fastener tapes, and an input electrode section or an output electrode section is concurrently engaged with the top holding section and the bottom holding section to close opening-closing ends in the vertical upward and downward directions. When at least one of the element-upper-leg portion and the element-lower-leg portion of the slide fastener is made of an elastic material, by sliding the slider along the elements arranged so as to face one another, the elements are interlocked to close the opening-closing ends in the horizontal direction, which are the opposing fastener tapes, and the input electrode section or the output electrode section is concurrently engaged, or subsequently joined in a push-in manner, with the top holding section and the bottom holding section to close the opening-closing ends in the vertical upward and downward directions. A power and/or signal input-output line is formed by connecting a power supply input line and/or a signal input-output line to one of the opening-closing ends in the horizontal direction and the opening-closing ends in the vertical upward and downward directions or concurrently engaging, or subsequently joining in a push-in manner, the input electrode section to which the power supply input line and/or the signal input-output line is/are connected with the one of the opening-closing ends and by connecting a power supply output line extending to the powered device and/or a signal input-output line extending to the powered device to another one of the opening-closing ends or concurrently engaging, or subsequently joining in a push-in manner, the output electrode section to which the power supply output line extending to the powered device and/or the signal input-output line extending to the powered device is/are connected with the other one of the opening-closing ends.

The slide fastener according to a second embodiment of the invention is the slide fastener according to the first embodiment of the invention, in which each of electrodes electrically connected together inside the interlock portions or along surfaces of the interlock portions is embedded in either one of: the opposing fastener tapes; end portions of the element-upper-leg portions forming the top holding section; inner portions of the element-upper-leg portions; end portions of the element-lower-leg portions forming the bottom holding section; and inner portions of the element-lower-leg portions, the opposing fastener tapes, the end portions of the element-upper-leg portions, the inner portions of the element-upper-leg portions, the end portions of the element-lower-leg portions, and the inner portions of the element-lower-leg portions being opening-closing ends to which the power supply input line and/or the signal input-output line and the power supply output line extending to the powered device and/or the signal input-output line extending to the powered device are connected or with which the input electrode section to which the power supply input line and/or the signal input-output line is/are connected and the output electrode section to which the power supply output line extending to the powered device and/or the signal input-output line extending to the powered device is/are connected are concurrently engaged, or subsequently joined in a push-in manner, the opening-closing ends being chosen from among the opening-closing ends in the horizontal direction and the opening-closing ends in the vertical upward and downward directions.

The slide fastener according to a third embodiment of the invention is a slide fastener that is interposed between a powered device on an output side and a power supply unit and a signal unit on an input side, the slide fastener being connected to one or more slide fasteners and forming an input-output line that activates the powered device via a coupling electrode portion as a result of a closing operation of the slide fastener, an external input-output terminal being provided to the coupling electrode portion from a middle of a coupling portion, the slide fastener comprising a plurality of fastener units, each of which includes: rows of elements arranged so as to face one another along edges of opening-closing ends of opposing fastener tapes; and a slider. Each of the elements includes: an interlock portion provided on a first side in a horizontal direction; and a fastener-tape fixing portion provided on a second side in the horizontal direction; an element-upper-leg portion and an element-lower-leg portion that extend in vertical upward and downward directions with respect to the horizontal direction, a portion of the element-upper-leg portion extended in the vertical upward direction being bent into a hook shape, and a portion of the element-lower-leg portion extended in the vertical downward direction being formed into a hook shape, and wherein the elements are arranged so as to face one another and form a top holding section by bringing ends of the element-upper-leg portions arranged so as to face one another closer to or away from one another and to form a bottom holding section by bringing ends of the element-lower-leg portions arranged so as to face one another closer to or away from one another in cooperation with interlock or separation of the interlock portions of the elements arranged so as to face one another. By sliding the slider along the elements arranged so as to face one another, the elements are interlocked to close opening-closing ends in the horizontal direction, which are the opposing fastener tapes, and an input electrode section or an output electrode section is concurrently engaged with the top holding section and the bottom holding section to close opening-closing ends in the vertical upward and downward directions. The plurality of fastener units include a fastener unit in which the element-upper-leg portion and the element-lower-leg portion are made of a nonelastic material and a fastener unit in which at least one of the element-upper-leg portion and the element-lower-leg portion is made of an elastic material. In a case of the fastener unit in which the element-upper-leg portion and the element-lower-leg portion are made of the nonelastic material among the plurality of fastener units, when the elements of each fastener unit arranged so as to face one another are interlocked by sliding the slider of the fastener unit along the elements of the fastener unit, a top holding section of a first one of the fastener units and a bottom holding section of a second one of the fastener units or a bottom holding section of the first fastener unit and a top holding section of the second one of the fastener units are coupled together using the coupling electrode portion and then a bottom holding section of a new fastener unit and a top holding section of a previous fastener unit or a top holding section of a new fastener unit and a bottom holding section of a previous fastener unit are sequentially coupled together using the coupling electrode portion. In a case of the fastener unit in which at least one of the element-upper-leg portion and the element-lower-leg portion is made of an elastic material among the plurality of fastener units, in a case where the other one of the element-upper-leg portion and the element-lower-leg portion is made of a nonelastic material, when the elements of each fastener unit arranged so as to face one another are interlocked by sliding the slider of the fastener unit along the elements of the fastener unit, the top holding section of the first fastener unit and the bottom holding section of the second one of the fastener units or the bottom holding section of the first fastener unit and the top holding section of the second one of the fastener units are coupled together using the coupling electrode portion and then a bottom holding section of a new fastener unit and a top holding section of a previous fastener unit or a top holding section of the new fastener unit and a bottom holding section of the previous fastener unit are sequentially coupled together using the coupling electrode portion. In a case where the other one of the element-upper-leg portion and the element-lower-leg portion is made of an elastic material, when the elements of each fastener unit arranged so as to face one another are interlocked by sliding the slider of the fastener unit along the elements of the fastener unit, the top holding section of the first fastener unit and the bottom holding section of the second one of the fastener units or the bottom holding section of the first fastener unit and the top holding section of the second one of the fastener units are coupled together at the time of being engaged with the coupling electrode portion or subsequently in a push-in manner, and then a bottom holding section of a new fastener unit and a top holding section of a previous fastener unit or a top holding section of a new fastener unit and a bottom holding section of a previous fastener unit are coupled together at the time of being engaged with the coupling electrode portion or subsequently in a push-in manner, so that the plurality of fastener units are formed into a stacked structure. A power and/or signal input-output line is formed by connecting a power supply input line and/or a signal input-output line to one of the opening-closing ends in the horizontal direction of the plurality of fastener units formed into the stacked structure and the opening-closing ends in a vertical direction of an uppermost fastener unit and a lowermost fastener unit or engaging, or joining in a push-in manner, the input electrode section to which the power supply input line and/or the signal input-output line is/are connected with the one of the opening-closing ends and by connecting the power supply output line extending to the powered device and/or the signal input-output line extending to the powered device to another one of the opening-closing ends or engaging, or joining in a push-in manner, the output electrode section to which the power supply output line extending to the powered device and/or the signal input-output line extending to the powered device is/are connected with the other one of the opening-closing ends.

The slide fastener according to a fourth embodiment of the invention is the slide fastener according to the third embodiment of the invention, in which each of electrodes electrically connected together inside the interlock portions or along surfaces of the interlock portions is embedded in either one of: the opposing fastener tapes; end portions of the element-upper-leg portions forming the top holding section; inner portions of the element-upper-leg portions; end portions of the element-lower-leg portions forming the bottom holding section; and inner portions of the element-lower-leg portions, the opposing fastener tapes, the end portions of the element-upper-leg portions, the inner portions of the element-upper-leg portions, the end portions of the element-lower-leg portions, and the inner portions of the element-lower-leg portions being opening-closing ends to which the power supply input line and/or the signal input-output line and the power supply output line extending to the powered device and/or the signal input-output line extending to the powered device are connected or with which the input electrode section to which the power supply input line and/or the signal input-output line is/are connected and the output electrode section to which the power supply output line extending to the powered device and/or the signal input-output line extending to the powered device is/are connected are engaged, or subsequently joined in a push-in manner, the opening-closing ends being chosen from among the opening-closing ends in the horizontal direction of the plurality of fastener units formed into the stacked structure and the opening-closing ends in the vertical upward and downward directions of an uppermost fastener unit and a lowermost fastener unit.

The slide fastener according to a fifth embodiment of the invention is a slide fastener that is interposed between a powered device on an output side and a power supply unit and a signal unit on an input side, the slide fastener forming an input-output line that activates the powered device with a closing operation of the slide fastener, the slide fastener comprising: rows of elements arranged so as to face one another along edges of opening-closing ends of opposing fastener tapes; and a slider. Each of the elements includes: an interlock portion provided on a first side in a horizontal direction; a fastener-tape fixing portion provided on a second side in the horizontal direction; and an element-leg portion that extends in one vertical direction with respect to the horizontal direction, an extended portion of the element-leg portion being bent into a hook shape. The elements are arranged so as to face one another and form a holding section by bringing ends of the element-leg portions arranged so as to face one another closer to or away from one another in cooperation with interlock or separation of the interlock portions of the elements arranged so as to face one another. When the element-leg portion of the slide fastener is made of a nonelastic material, by sliding the slider along the elements arranged so as to face one another, the elements are interlocked to close opening-closing ends in the horizontal direction, which are opposing fastener tapes, and an input electrode section or an output electrode section is concurrently engaged with the holding section to close the opening-closing end in the one vertical direction, whereas when the element-leg portion of the slide fastener is made of an elastic material, by sliding the slider along the elements arranged so as to face one another, the elements are interlocked to close the opening-closing ends in the horizontal direction, which are the opposing fastener tapes, and the input electrode section or the output electrode section is concurrently engaged, or subsequently joined in a push-in manner, with the holding section to close the opening-closing end in the one vertical direction. A power and/or signal input-output line is formed by connecting a power supply input line and/or a signal input-output line to one of the opening-closing ends in the horizontal direction and the opening-closing end in the one vertical direction or concurrently engaging, or subsequently joining in a push-in manner, the input electrode section to which the power supply input line and/or the signal input-output line is/are connected with the one of the opening-closing ends and by connecting a power supply output line extending to the powered device and/or a signal input-output line extending to the powered device to another one of the opening-closing ends or concurrently engaging, or subsequently joining in a push-in manner, the output electrode section to which the power supply output line extending to the powered device and/or the signal input-output line extending to the powered device is/are connected with the other one of the opening-closing ends.

The slide fastener according to a sixth embodiment of the invention is the slide fastener according to the fourth embodiment of the invention, in which each of electrodes electrically connected together inside the interlock portions or along surfaces of the interlock portions is embedded in either one of: the opposing fastener tapes; end portions of the element-leg portions forming the holding section; and inner portions of the element-leg portions, the opposing fastener tapes, the end portions of the element-leg portions, and the inner portions of the element-leg portions being opening-closing ends to which the power supply input line and/or the signal input-output line and the power supply output line extending to the powered device and/or the signal input-output line extending to the powered device are connected or with which the input electrode section to which the power supply input line and/or the signal input-output line is/are connected and the output electrode section to which the power supply output line extending to the powered device and/or the signal input-output line extending to the powered device is/are connected are concurrently engaged, or subsequently joined in a push-in manner.

The slide fastener according to a seventh embodiment of the invention is a slide fastener that is interposed between a powered device on an output side and a power supply unit and a signal unit on an input side, the slide fastener being connected to one or more slide fasteners and forming an input-output line that activates the powered device via a coupling electrode portion as a result of a closing operation of the slide fastener, an external input-output terminal being provided to the coupling electrode portion from a middle of a coupling portion, the slide fastener comprising two fastener units, each of which includes: rows of elements arranged so as to face one another along edges of opening-closing ends of opposing fastener tapes; and a slider. Each of the elements includes: an interlock portion provided on a first side in a horizontal direction; a fastener-tape fixing portion provided on a second side in the horizontal direction; and an element-leg portion that extends in one vertical direction with respect to the horizontal direction, an extended portion of the element-leg portion being bent into a hook shape, and wherein the elements are arranged so as to face one another and form a holding section by bringing ends of the element-leg portions arranged so as to face one another closer to or away from one another in cooperation with interlock or separation of the interlock portions of the elements arranged so as to face one another. By sliding the slider along the elements arranged so as to face one another, the elements are interlocked to close opening-closing ends in the horizontal direction, which are the opposing fastener tapes, and an input electrode section or an output electrode section is concurrently engaged with the holding section to close an opening-closing end in the one vertical direction. The two fastener units include a fastener unit in which the element-leg portion is made of a nonelastic material and a fastener unit in which the element-leg portion is made of an elastic material. In a case where the two fastener units each include an element-leg portion made of a nonelastic material, when the elements of the two fastener units arranged so as to face one another are interlocked by sliding the sliders of the two fastener units along the elements of the fastener units, the holding sections of the two fastener units are coupled together in a vertical direction using the coupling electrode portion. In a case where at least a first one of the two fastener units includes the element-leg portion made of an elastic material, in a case where a second one of the fastener units includes the element-leg portion made of a nonelastic material, when the elements of the fastener unit including the element-leg portion made of a nonelastic material are interlocked by sliding the slider of the fastener unit along the elements of the fastener unit arranged so as to face one another, the holding sections of the fastener units are coupled together in the vertical direction using the coupling electrode portion and then, when the elements of the fastener unit including the element-leg portion made of an elastic material are interlocked, the holding portions are concurrently coupled together using the coupling electrode portion or subsequently coupled together in the vertical direction in a push-in manner. In a case where the second one of the fastener units includes an element-leg portion made of an elastic material, when the elements of the two fastener units arranged so as to face one another are interlocked by sliding the sliders of the two fastener units along the elements of the fastener units, the holding sections of the fastener units each including the element-leg portion made of an elastic material are coupled together using the coupling electrode portion or coupled together in the vertical direction in a push-in manner after the elements have been interlocked, so that the two fastener units are formed into a stacked structure. A power and/or signal input-output line is formed by connecting a power supply input line and/or a signal input-output line to the opening-closing ends in the horizontal direction of the first one of the two fastener units formed into the stacked structure and connecting the power supply output line extending to the powered device and/or the signal input-output line extending to the powered device to the opening-closing ends in the horizontal direction of the second one of the fastener units.

The slide fastener according to an eighth embodiment of the invention is the slide fastener according to the seventh embodiment of the invention, in which each of electrodes electrically connected together inside the interlock portions or along surfaces of the interlock portions is embedded in either one of: the opposing fastener tapes; end portions of the element-leg portions forming the holding sections coupled together in the vertical direction using the coupling electrode portion or coupled together in a push-in manner; and inner portions of the element-leg portions, the power supply input line and/or the signal input-output line or the power supply output line extending to the powered device and/or the signal input-output line extending to the powered device being connected to the opposing fastener tapes, the end portions of the element-leg portions, and the inner portions of the element-leg portions.

The slide fastener according to a ninth embodiment of the invention is a slide fastener that is interposed between a powered device on an output side and a power supply unit and a signal unit on an input side and forming an input-output line that activates the powered device with a closing operation of the slide fastener, the slide fastener being interposed between a powered device on an output side and a power supply unit and a signal unit on an input side and forming an input-output line that activates the powered device with a closing operation of the slide fastener via an input electrode section and an output electrode section, the input electrode section connecting the power supply unit and the signal unit to the input side of the slide fastener and connecting the powered device to the output side of the slide fastener, the slide fastener comprising a plurality of fastener units, each of which includes: rows of elements arranged so as to face one another along edges of opening-closing ends of opposing fastener tapes; and a slider. Each of the elements includes: an interlock portion provided on a first side in a horizontal direction; a fastener-tape fixing portion provided on a second side in the horizontal direction; and an engagement piece and an engagement-piece receiving piece that extend in vertical upward and downward directions with respect to the horizontal direction, a portion of the engagement piece extending in the vertical upward direction being formed into an arrow-head shape, and a portion of the engagement-piece receiving piece extending in the vertical downward direction being bent into a hook shape. The elements are arranged so as to face one another so that engagement pieces of the elements arranged so as to face one another form engagement portions and engagement-piece receiving pieces of the elements arranged so as to face one another form engagement-portion receiving portions in cooperation with interlock or separation of the interlock portions of the elements arranged so as to face one another. By sliding the slider along the elements arranged so as to face one another, the elements are interlocked to close opening-closing ends in the horizontal direction, which are the opposing fastener tapes, and concurrently close an opening-closing end of the engagement-portion receiving portion extending downward. In a case where the plurality of fastener units include a fastener unit that includes an engagement-piece receiving piece extending downward and made of a nonelastic material and a fastener unit that includes an engagement-piece receiving piece extending downward and made of an elastic material and the fastener unit of the plurality of fastener units including the engagement-piece receiving piece made of the nonelastic material is connected to other fastener units in a stacked manner, the plurality of fastener units are formed into a stacked structure by engaging, when the elements of each fastener unit are interlocked by sliding the slider of the fastener unit along the elements of the fastener unit, an engagement portion of a first one of the fastener units in which the interlock portions have been interlocked with an engagement-portion receiving portion of a second one of the fastener units made of a nonelastic material and by sequentially engaging an engagement portion of a previous fastener unit with an engagement-portion receiving portion of a new fastener unit, whereas in a case where the fastener unit including the engagement-piece receiving piece made of an elastic material is connected to other fastener units in a stacked manner, the plurality of fastener units are formed into the stacked structure by engaging, when the elements of each fastener unit are interlocked by sliding the slider of the fastener unit along the elements of the fastener unit, an engagement portion of a first one of the fastener units in which the interlock portions have been interlocked with an engagement-portion receiving portion of a second one of the fastener units made of an elastic material and concurrently engaging, or subsequently joining in a push-in manner, an engagement portion of a previous fastener unit with an engagement-portion receiving portion of a new fastener unit. A power and/or signal input-output line is formed by connecting a power supply input line and/or a signal input-output line to one of the opening-closing ends in the horizontal direction of the plurality of fastener units formed into the stacked structure and the opening-closing ends of an engagement-portion receiving portion of a lowermost fastener unit or engaging, or joining in a push-in manner, the input electrode section to which the power supply input line and/or the signal input-output line is/are connected with the one of the opening-closing ends and by connecting the power supply output line extending to the powered device and/or the signal input-output line extending to the powered device to another one of the opening-closing ends or engaging, or joining in a push-in manner, the output electrode section to which the power supply output line extending to the powered device and/or the signal input-output line extending to the powered device is/are connected with the other one of the opening-closing ends.

The slide fastener according to a tenth embodiment of the invention is the slide fastener according to the ninth embodiment of the invention, in which each of electrodes electrically connected together inside the interlock portions or along surfaces of the interlock portions is embedded in either one of: the opposing fastener tapes; and the engagement pieces and the engagement-piece receiving pieces connected in a stacked manner among the engagement pieces and the engagement-piece receiving pieces of the plurality of fastener units formed into the stacked structure, the opposing fastener tapes and the connected engagement pieces and engagement-piece receiving pieces being opening-closing ends to which the power supply input line and/or the signal input-output line or the power supply output line extending to the powered device and/or the signal input-output line extending to the powered device is/are connected, the opening-closing ends being chosen from among the opening-closing ends in the horizontal direction of the plurality of fastener units formed into the stacked structure.

The slide fastener according to an eleventh embodiment of the invention is the slide fastener according to any one of the first to tenth embodiments of the invention, in which the power and/or signal input-output line is stretchably provided along a ceiling in a building, a wall, an outer wall of a building, or a roadside tree or radially from a standing pole in such a manner as to stretch a rope.

Advantageous Effects of Invention

According to the slide fastener of the present invention, an input-output line that activates a powered device is formed by a closing operation of the slide fastener that has uniquely shaped elements and that is interposed between the powered device on an output side and a power supply unit and a signal unit on an input side. Thus, places at which the powered device is installed are not limited and the power device that has been installed may be moved to and used in another place.

Each of the elements includes: an interlock portion provided on a first side in a horizontal direction; a fastener-tape fixing portion provided on a second side in the horizontal direction; and leg portions that extend in the vertical directions with respect to the horizontal direction, extended portions of the leg portions being bent into hook shapes. The elements are arranged so as to face one another and form holding sections by bringing ends of the leg portions arranged so as to face one another closer to or away from one another in cooperation with interlock or separation of the interlock portions of the elements arranged so as to face one another. By sliding the slider along the elements arranged so as to face one another, the elements are interlocked to close opening-closing ends in the horizontal direction, which are the opposing fastener tapes, and an input electrode section or an output electrode section is concurrently engaged with the holding sections to close opening-closing ends in the vertical directions, and a power supply unit, a signal unit, and a wide range of powered devices can be activated while being positioned at any positions of the opening-closing ends in the horizontal direction and the opening-closing ends in the vertical directions of the slider fastener. In addition, a powered device can be appropriately controlled by a signal unit.

In the case of a slide fastener including a leg portion extending in the vertical direction and made of a nonelastic material, by sliding the slider along the elements arranged so as to face one another, the elements are interlocked to close opening-closing ends in the horizontal direction, which are opposing fastener tapes, and an input electrode section or an output electrode section is concurrently engaged with the holding section to close the opening-closing end in the vertical direction. The powered device can thus be fixed at any portion of the slide fastener using the slider. In the case of a slide fastener including a leg portion extending in the vertical direction and made of an elastic material, by sliding the slider along the elements arranged so as to face one another, the elements are interlocked to close opening-closing ends in the horizontal direction, which are opposing fastener tapes, and the input electrode section or the output electrode section is concurrently engaged, or subsequently joined in a push-in manner, with the holding section to close the opening-closing end in the vertical direction. The powered device can thus be fixed at any portion of the slide fastener using the slider or an additional powered device can be fixed by being subsequently provided to the slide fastener in a push-in manner.

DESCRIPTION OF PREFERRED EMBODIMENTS

Embodiments

Figure 1:
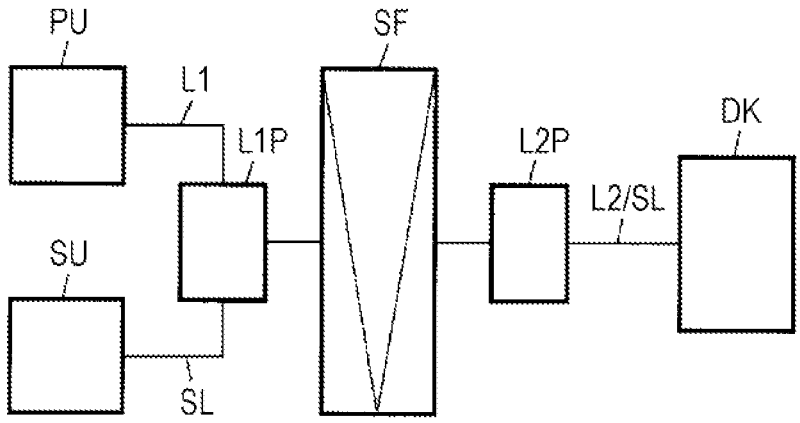
FIG. 1 is a schematic diagram of a power and/or signal input-output line formed by a closing operation of a slide fastener according to the present invention.

FIG. 1 is a schematic diagram of a configuration in which a power and/or signal input-output line is formed by a closing operation of a slide fastener according to the present invention, where SF denotes a slide fastener including uniquely shaped elements created by means of a new idea, PU denotes a power supply unit connected to an input side of the slide fastener SF through a power supply input line L1 via an input electrode section L1P, SU denotes a signal unit connected to the input side of the slide fastener SF through a signal input-output line SL via the input electrode section L1P, and DK denotes a powered device connected to an output side of the slide fastener SF through a power supply output line L2 and/or a signal input-output line SL via an output electrode section L2P.

By closing the slide fastener SF including uniquely shaped elements, a power and/or signal input-output line L12 that connects the power supply unit PU and the signal unit SU, provided on the input side of the slide fastener SF, to the powered device DK, provided on the output side of the slide fastener SF is formed. Hereinbelow, a slide fastener according to each embodiment will be specifically described with reference to the drawings.

Figure 2:
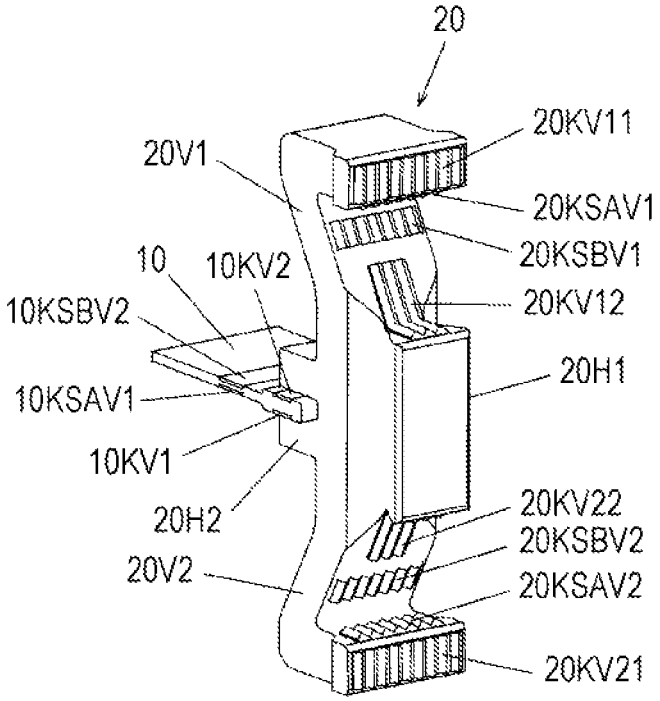
FIG. 2 illustrates an element or elements constituting a slide fastener according to a first embodiment of the present invention where part (a) illustrates a single element and part (b) illustrates elements that face each other.
Figure 2:
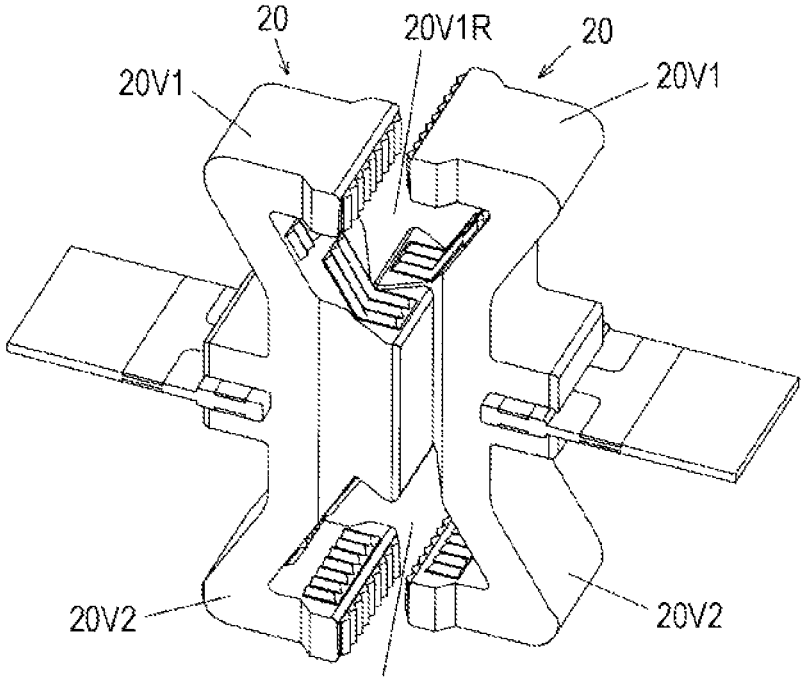

FIG. 2 to FIG. 7 are illustrations relating to a slide fastener according to a first embodiment of the present invention. As illustrated in FIG. 2(*a*), an element 20 constituting a slide fastener SF1 includes an interlock portion 20H1 on one side in the horizontal direction H1 and a fastener-tape fixing portion 20H2, to which a fastener tape 10 is fixed, on the other side in the horizontal direction H1. The element 20 extends in vertical upward and downward directions V11 and V12 with respect to the horizontal direction H1. The element 20 includes an element-upper-leg portion 20V1 and an element-lower-leg portion 20V2. An upper portion of the element-upper-leg portion 20V1 that extends in the vertical upward direction V11 is bent into a hook shape. A lower portion of the element-lower-leg portion 20V2 that extends in the vertical downward direction V12 is bent into a hook shape.

A (positive) power electrode 20KV11 is embedded in an end portion of the element-upper-leg portion 20V1. A (negative) power electrode 20KV12, an electrode 20KSAV1 for a signal A, and an electrode 20KSBV1 for a signal B are embedded in the element-upper-leg portion 20V1. A (positive) power electrode 20KV21 is embedded in an end portion of the element-lower-leg portion 20V2. A (negative) power electrode 20KV22, an electrode 20KSAV2 for a signal A, and an electrode 20KSBV2 for a signal B are embedded in the element-lower-leg portion 20V2.

The (positive) power electrode 20KV11 embedded in the end portion of the element-upper-leg portion 20V1, the (positive) power electrode 20KV21 embedded in the end portion of the element-lower-leg portion 20V2, the (negative) power electrode 20KV12 embedded in the element-upper-leg portion 20V1, and the (negative) power electrode 20KV22 embedded in the element-lower-leg portion 20V2 are electrically connected together inside the interlock portion 20H1 or along the surface of the interlock portion 20H1 and further connected to a (positive) power electrode 10KV1 and a (negative) power electrode 10KV2 embedded in the fastener tape 10 fixed to the fastener-tape fixing portion 20H2. The electrode 20KSAV1 for the signal A and the electrode 20KSBV1 for the signal B embedded in the element-upper-leg portion 20V1 and the electrode 20KSAV2 for the signal A and the electrode 20KSBV2 for the signal B embedded in the element-lower-leg portion 20V2 are electrically connected together inside the interlock portion 20H1 and further connected to an electrode 10KSAV1 for the signal A and an electrode 10KSBV2 for the signal B embedded in the fastener tape 10 fixed to the fastener-tape fixing portion 20H2.

As illustrated in FIG. 2(*b*), elements 20 of this type are arranged so as to face each other. In cooperation with interlock or separation of the interlock portions 20H1 and 20H1 of first and second elements 20 and 20 arranged so as to face each other, end portions of the element-upper-leg portions 20V1 and 20V1 arranged so as to face each other form a top holding section 20V1R by coming closer to and becoming separated from each other and end portions of the element-lower-leg portions 20V2 and 20V2 arranged so as to face each other form a bottom holding section 20V2R by coming closer to and becoming separated from each other.

Figure 3:
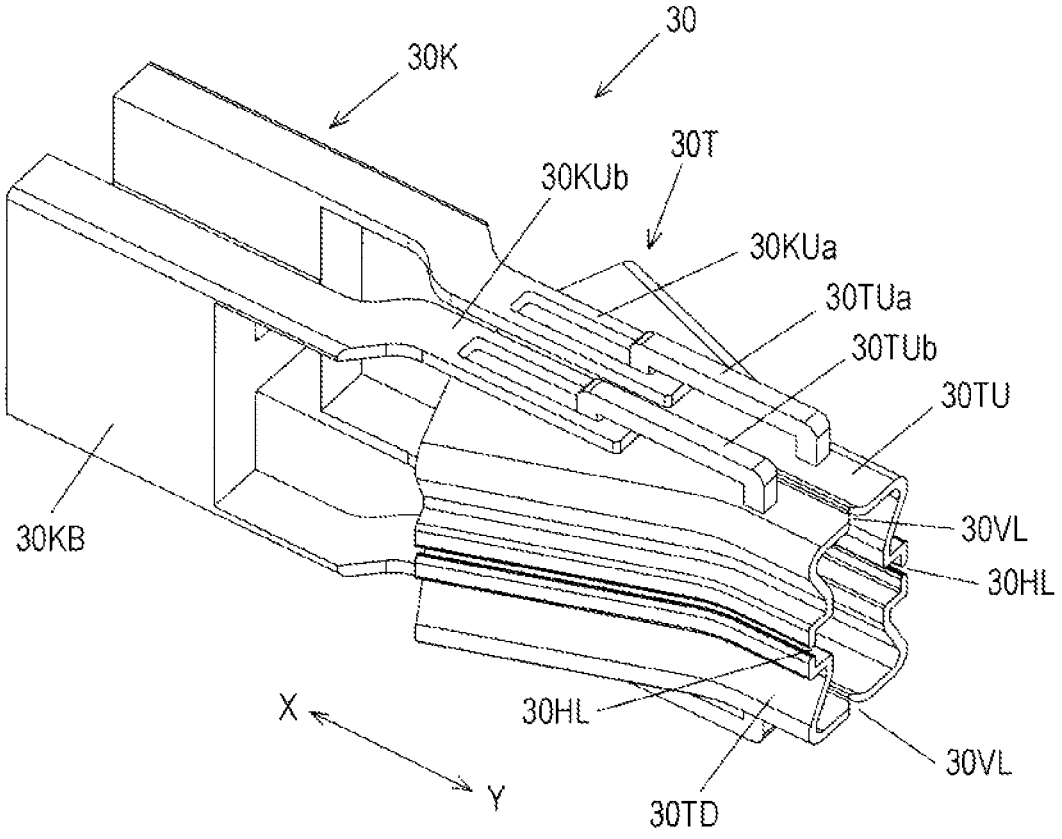
FIG. 3 is a perspective view of a slider constituting the slide fastener according to the first embodiment.

As illustrated in FIG. 3, a slider 30 constituting the slide fastener SF1 includes a slider body 30T, which interlocks and unlocks the elements 20 by causing the elements 20 to pass therethrough, and a tab 30K that moves the slider body 30T. The slider body 30T includes an upper-vertical-side case 30TU and a lower-vertical-side case 30TD. Horizontal slits 30HL are formed between the upper-vertical-side case 30TU and the lower-vertical-side case 30TD. The horizontal slits 30HL allow the opposing fastener tapes 10 serving as opening-closing ends HT in the horizontal direction H to pass therethrough. Vertical slits 30VL are formed at the middle of the upper-vertical-side case 30TU and the lower-vertical-side case 30TD so as to correspond to an opening-closing end V1T of the vertical upward direction V1 and an opening-closing end V2T of the vertical downward direction V2.

Upper tab attachment portions 30TUa and 30TUb are erectly provided to the upper-vertical-side case 30TU on both sides of the vertical slit 30VL. Lower tab attachment portions 30TDa and 30TDb, which are illustrated only partially, are erectly provided to the lower-vertical-side case 30TD on both sides of the vertical slit 30VL.

The tab 30K includes upper attachment portions 30KUa and 30KUb, lower attachment portions 30KDa and 30KDb, and a tab portion 30KB. The upper attachment portions 30KUa and 30KUb and the lower attachment portions 30KDa and 30KDb are attached to the slider body 30T. The upper attachment portions 30KUa and 30KUb are attached to the upper tab attachment portions 30TUa and 30TUb on the upper-vertical-side case 30TU of the slider body 30T and the lower attachment portions 30KDa and 30KDb are attached to the lower tab attachment portions 30TDa and 30TDb on the lower-vertical-side case 30TD of the slider body 30T in such a manner that the upper attachment portions 30KUa and 30KUb and the lower attachment portions 30KDa and 30KDb sandwich the slider body 30T from above and below. In this case, the tab 30K is pulled in the direction of the arrow X to close the slide fastener while the tab 30K is pushed in the direction of the arrow Y to open the slide fastener.

Figure 4:
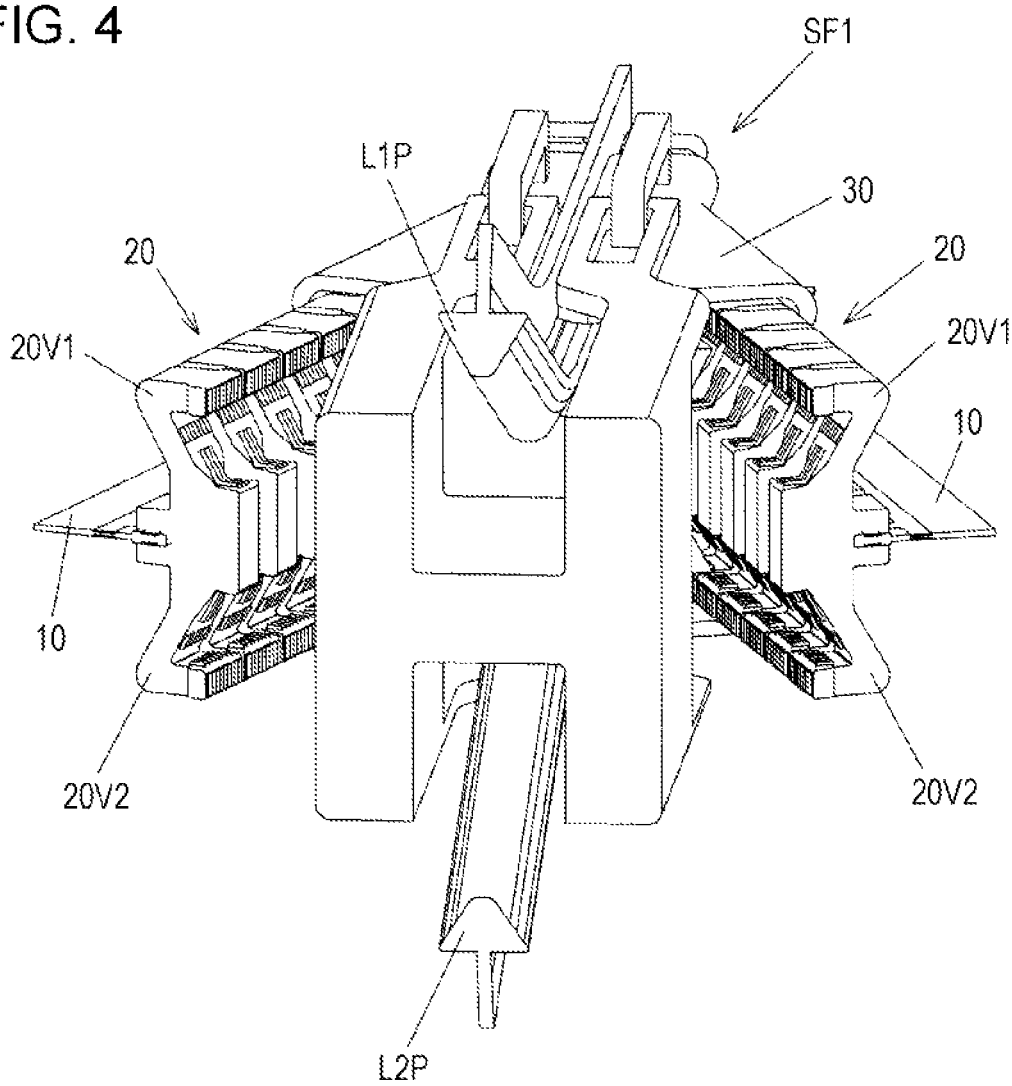
FIG. 4 is a perspective view of a slide fastener that forms a power and/or signal input-output line using the elements and the slider of the slide fastener according to the first embodiment.
Figure 5:
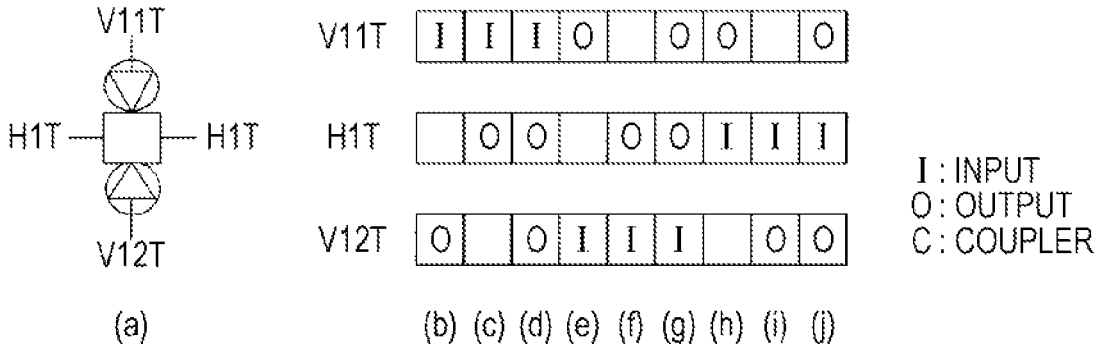
FIG. 5 Part (a) is a schematic diagram illustrating opening-closing ends that open or close as a result of an operation being performed on the slide fastener according to the first embodiment and part (b) to part (j) are diagrams of combination patterns.

FIG. 4 is a perspective view of a slide fastener SF1 that forms a power and/or signal input-output line using the elements and the slider of the slide fastener according to the first embodiment. FIG. 5(*a*) is a schematic diagram of opening-closing ends H1T in the horizontal direction H1 and opening-closing ends V11T and V12T in the vertical upward and downward directions V11 and V12, which are closed by sliding the slider 30 of the slide fastener SF1 according to the first embodiment along the elements 20. In FIG. 4, in the case where the element-upper-leg portion 20V1 and the element-lower-leg portion 20V2 of each element 20 are both made of a nonelastic material, a power and/or signal input-output line L12 is formed in the following manner. By sliding the slider 30 along the elements 20 and 20 arranged so as to face each other, the elements 20 and 20 are interlocked to close the opening-closing ends H1T in the horizontal direction H1, which are opposing fastener tapes 10, and the input electrode section L1P or the output electrode section L2P is concurrently engaged with the top holding section 20V1R and the bottom holding section 20V2R to close the opening-closing ends V11T and V12T in the vertical upward and downward directions V11 and V12. Moreover, the power supply input line L1 and/or the signal input-output line SL is/are connected to one of the opening-closing ends H1T in the horizontal direction H1 and the opening-closing ends V11T and V12T in the vertical upward and downward directions V11 and V12 or the input electrode section L1P to which the power supply input line L1 and/or the signal input-output line SL is/are connected is concurrently engaged with the opening-closing end. In addition, the power supply output line L2 extending to the powered device DK and/or the signal input-output line SL extending to the powered device DK is/are connected to another one of the remaining opening-closing ends or the output electrode section L2P to which the power supply output line L2 extending to the powered device DK and/or the signal input-output line SL extending to the powered device DK is/are connected is concurrently engaged with another one of the remaining opening-closing ends.

Alternatively, in the case where at least one of the element-upper-leg portion 20V1 and the element-lower-leg portion 20V2 of each element 20 is made of an elastic material, a power and/or signal input-output line L12 is formed in the following manner. By sliding the slider 30 along the elements 20 and 20 arranged so as to face each other, the elements 20 and 20 are interlocked to close the opening-closing ends H1T in the horizontal direction H1, which are opposing fastener tapes 10, and the input electrode section L1P or the output electrode section L2P is concurrently engaged, or subsequently joining in a push-in manner, with the top holding section 20V1R and the bottom holding section 20V2R to close the opening-closing ends V11T and V12T in the vertical upward and downward directions V11 and V12. Moreover, the power supply input line L1 and/or the signal input-output line SL is/are connected to one of the opening-closing ends H1T in the horizontal direction H1 and the opening-closing ends V11T and V12T in the vertical upward and downward directions V11 and V12 or the input electrode section L1P to which the power supply input line L1 and/or the signal input-output line SL is/are connected is concurrently engaged, or subsequently joined in a push-in manner, with the opening-closing end. In addition, the power supply output line L2 extending to the powered device DK and/or the signal input-output line SL extending to the powered device DK is/are connected to another one of the remaining opening-closing ends or the output electrode section L2P to which the power supply output line L2 extending to the powered device DK and/or the signal input-output line SL extending to the powered device DK is/are connected is concurrently engaged, or subsequently joined in a push-in manner, with another one of the remaining opening-closing ends.

In addition, as illustrated in FIG. 5(*b*) to FIG. 5(*j*), there are nine combination patterns for forming an input-output line L12 illustrated in FIG. 5(*a*), by connecting the power supply input line L1 and/or the signal input-output line SL to one of the opening-closing ends H1T in the horizontal direction H1 and the opening-closing ends V11T and V12T in the vertical upward and downward directions V11 and V12 or engaging the input electrode section L1P to which the power supply input line L1 and/or the signal input-output line SL is/are connected with the one of the opening-closing ends and by connecting the power supply output line L2 extending to the powered device DK and/or the signal input-output line SL extending to the powered device DK to another one of the remaining opening-closing ends or engaging the output electrode section L2P to which the power supply output line L2 extending to the powered device DK and/or the signal input-output line SL extending to the powered device DK is/are connected with another one of the remaining opening-closing ends.

Specifically, when the opening-closing end V11T in the vertical upward direction V11 is chosen as an input terminal from among the opening-closing ends H1T in the horizontal direction H1 and the opening-closing ends V11T and V12T in the vertical upward and downward directions V11 and V12, there are three variations of output terminal/terminals including: the above-described opening-closing end V12T in the vertical downward direction V12 (FIG. 5(*b*)); the opening-closing ends H1T in the horizontal direction H1 (FIG. 5(*c*)); and the opening-closing ends H1T in the horizontal direction H1 and the opening-closing end V12T in the vertical downward direction V12 (FIG. 5(*d*)). When, on the other hand, the opening-closing end V12T in the vertical downward direction V12 is chosen as an input terminal from among the opening-closing ends H1T in the horizontal direction H1 and the opening-closing ends V11T and V12T in the vertical upward and downward directions V11 and V12, there are three variations of output terminal/terminals including: the opening-closing end V11T in the vertical upward direction V11 (FIG. 5(*e*)); the opening-closing ends H1T in the horizontal direction H1 (FIG. 5(*f*)); and the opening-closing ends H1T in the horizontal direction H1 and the opening-closing end V11T in the vertical upward direction V11 (FIG. 5(*g*)). Moreover, when the opening-closing ends H1T in the horizontal direction H1 are chosen as input terminals from among the opening-closing ends H1T in the horizontal direction H1 and the opening-closing ends V11T and V12T in the vertical upward and downward directions V11 and V12, there are three variations of output terminal/terminals including: the opening-closing end V11T in the vertical upward direction V11 (FIG. 5(*h*)); the opening-closing end V12T in the vertical downward direction V12 (FIG. 5(*i*)); and the opening-closing end V11T in the vertical upward direction V11 and the opening-closing end V12T in the vertical downward direction V12 (FIG. 5(*j*)). Consequently, there are nine combinations of input terminal/terminals and output terminal/terminals in total.

The electrodes may be embedded in the fastener tapes 10 of the first and second elements 20 arranged so as to face each other, in the end portion of the element-upper-leg portion 20V1, inside the element-upper-leg portion 20V1, in the end portion of the element-lower-leg portion 20V2, and inside the element-lower-leg portion 20V2 in any of the nine combinations illustrated in FIG. 5(*b*) to FIG. 5(*j*). Alternatively, these electrodes may be embedded only in the end portion of the element-upper-leg portion 20V1, inside the element-upper-leg portion 20V1, in the end portion of the element-lower-leg portion 20V2, inside the element-lower-leg portion 20V2, and in the fastener tapes 10, which are opening-closing ends to which the power supply input line L1 and/or the signal input-output line SL and the power supply output line L2 extending to the powered device DK and/or the signal input-output line SL extending to the powered device DK are connected or with which the input electrode section L1P to which the power supply input line L1 and/or the signal input-output line SL is/are connected and the output electrode section L2P to which the power supply output line L2 extending to the powered device DK and/or the signal input-output line SL extending to the powered device DK is/are connected are concurrently engaged, or subsequently joined in a push-in manner, the opening-closing ends being chosen from among the opening-closing ends H1T in the horizontal direction H1 and the opening-closing ends V11T and V12T in the vertical upward and downward directions V11 and V12.

Figure 6:
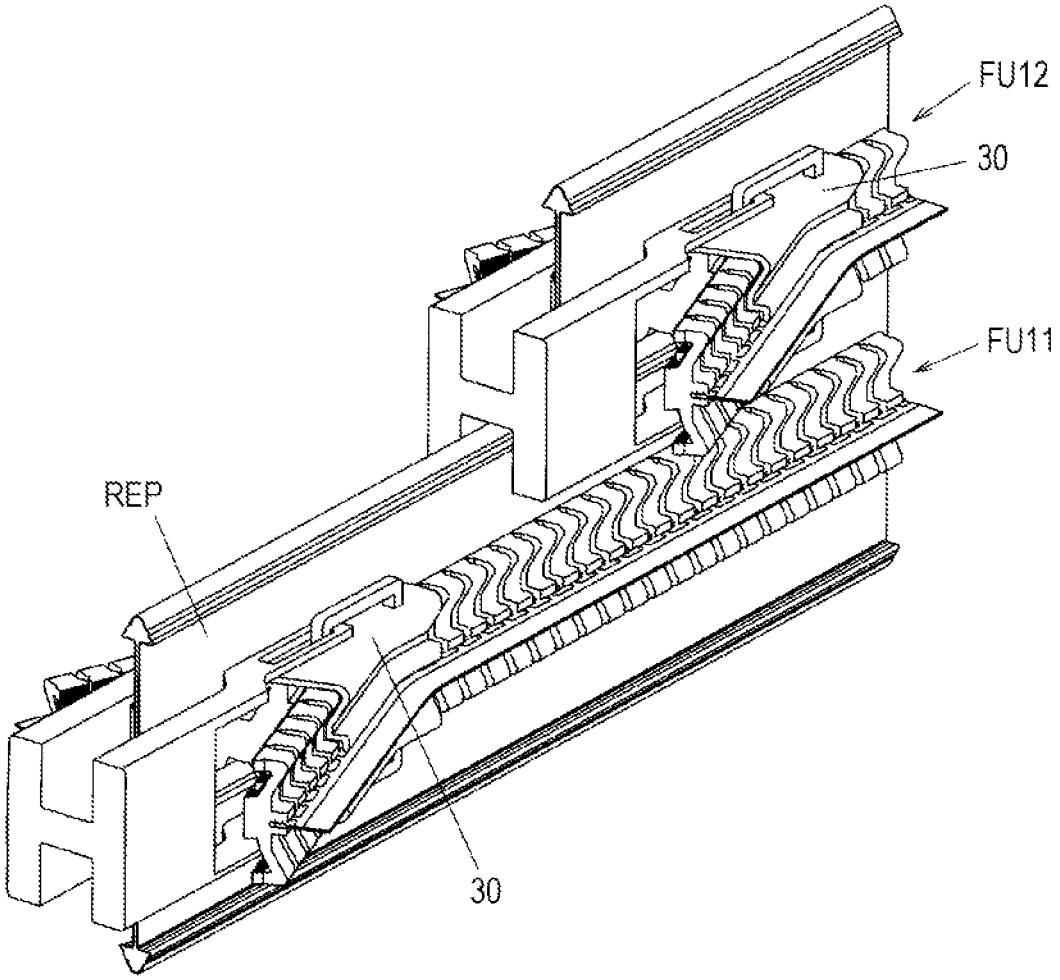
FIG. 6 is a perspective view of slide fasteners formed into a stacked structure by coupling the multiple slide fasteners according to the first embodiment.

FIG. 6 is a perspective view of the case where multiple slide fasteners SF1 according to the first embodiment, which are chosen as fastener units FU1, are formed into a stacked structure by coupling the top holding section 20V1R of a first fastener unit FU11 to the bottom holding section 20V2R of a second fastener unit FU12 using a coupling electrode portion REP and then sequentially coupling a bottom holding section of each new fastener unit to a top holding section of a previous fastener unit using a coupling electrode portion. In this drawing, in the case where each of multiple fastener units FU11, FU12, . . . is a fastener unit that includes an element-upper-leg portion 20V1 and an element-lower-leg portion 20V2 made of a nonelastic material, the multiple fastener units are formed into a stacked structure by, when the elements 20 and 20 of each fastener unit arranged so as to face one another are interlocked by sliding the slider 30 of the fastener unit along the elements 20 and 20 of the fastener unit, coupling the top holding section 20V1R of the first fastener unit FU11 to the bottom holding section 20V2R of the second fastener unit FU12 using the coupling electrode portion REP and then sequentially coupling the bottom holding section of each new fastener unit to the top holding section of the previous fastener unit using a coupling electrode portion.

Here, multiple fastener units may be formed into a stacked structure by coupling the bottom holding section 20V2R of the first fastener unit FU11 to the top holding section 20V1R of the second fastener unit FU12 using a coupling electrode portion REP and then sequentially coupling the top holding section of each new fastener unit to the bottom holding section of the previous fastener unit using a coupling electrode portion.

In the case where each of multiple fastener units FU11, FU12, . . . is a fastener unit that includes an element-upper-leg portion 20V1 and an element-lower-leg portion 20V2, at least one of which is made of an elastic material, if the another one of the element-upper-leg portion 20V1 and the element-lower-leg portion 20V2 is made of a nonelastic material, the multiple fastener units are formed into a stacked structure by coupling, when the elements 20 and 20 of each fastener unit arranged so as to face each other are interlocked by sliding the slider 30 of the fastener unit along the elements 20 and 20 of the fastener unit, the top holding section 20V1R of the first fastener unit FU1 to the bottom holding section 20V2R of the second fastener unit FU2 using the coupling electrode portion REP and then sequentially coupling the bottom holding section of each new fastener unit to the top holding section of the previous fastener unit using a coupling electrode portion.

Here, multiple fastener units may be formed into a stacked structure by coupling the bottom holding section 20V2R of the first fastener unit FU11 to the top holding section 20V1R of the second fastener unit FU12 using a coupling electrode portion REP and then sequentially coupling the top holding section of each new fastener unit to the bottom holding section of the previous fastener unit using a coupling electrode portion.

In the case where the another one of the element-upper-leg portion 20V1 and the element-lower-leg portion 20V2 is made of an elastic material, the multiple fastener units are formed into a stacked structure by, when the elements 20 and 20 of each fastener unit arranged so as to face each other are interlocked by sliding the slider 30 of the fastener unit along the elements 20 and 20 of the fastener unit, coupling the top holding section 20V1R of the first fastener unit FU11 to the bottom holding section 20V2R of the second fastener unit FU12 using a coupling electrode portion REP or joining them together in a push-in manner when the holding sections are engaged with a coupling electrode portion REP, and then sequentially coupling the bottom holding section of each new fastener unit to the top holding section of the previous fastener unit when the holding sections are engaged with or subsequently joined in a push in manner with the coupling electrode portion.

Here, multiple fastener units may be formed into a stacked structure by coupling the bottom holding section 20V2R of the first fastener unit FU11 to the top holding section 20V1R of the second fastener unit FU12 when the holding sections are engaged with the coupling electrode portion REP or subsequently joined together in a push-in manner and then sequentially coupling the top holding section of each new fastener unit to the bottom holding section of the previous fastener unit when the holding sections are engaged with the coupling electrode portion or joined together in a push-in manner.

Figure 7:
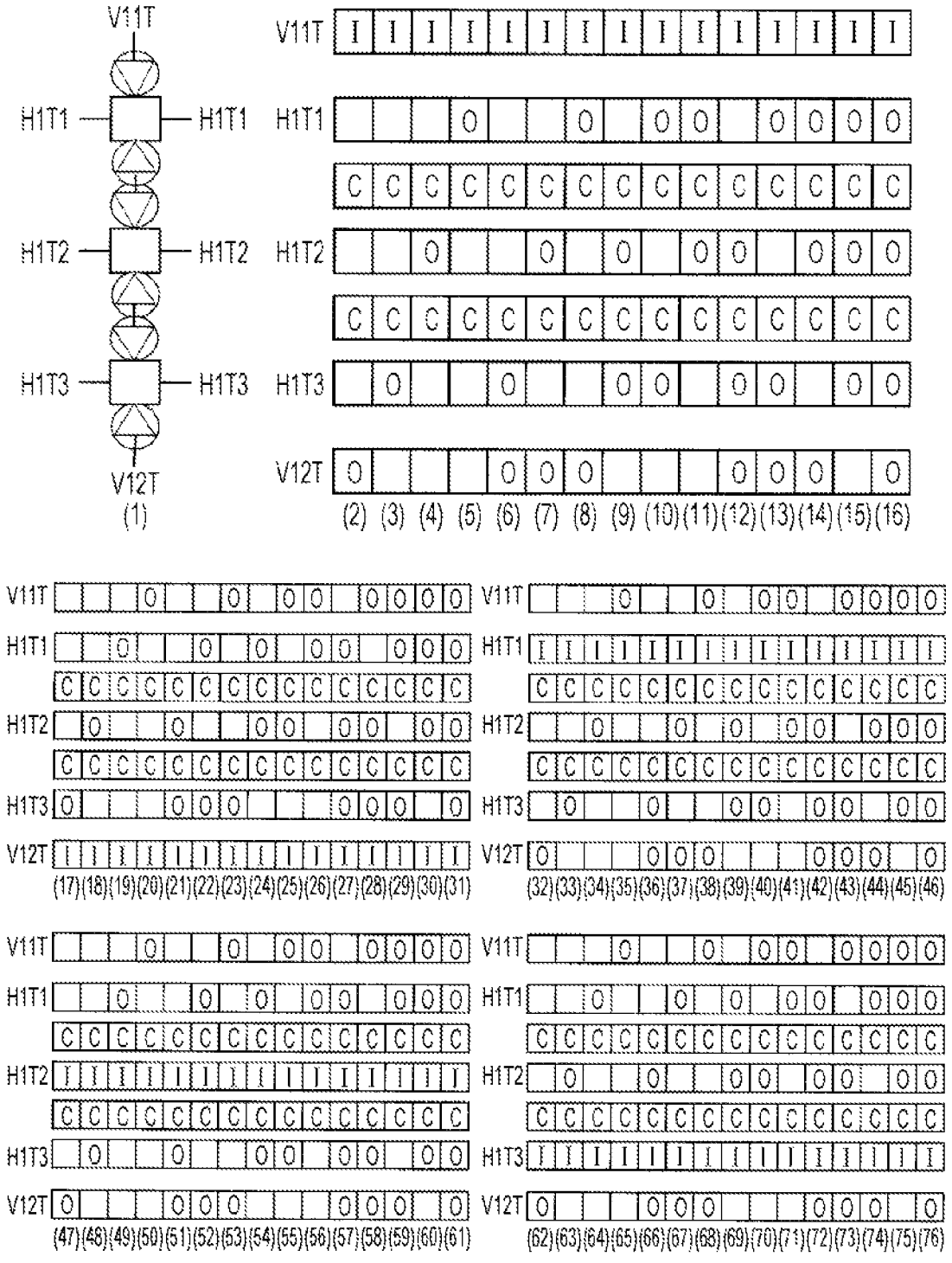
FIG. 7 Part (1) is a schematic diagram illustrating opening-closing ends that open or close as a result of an operation being performed on the slide fasteners formed into a stacked structure by coupling multiple slide fasteners according to the first embodiment and part (2) to part (76) are diagrams of combination patterns.

FIG. 7(1) is a schematic view of the opening-closing ends H1T1, H1T2, and H1T3 in the horizontal direction H1, which are closed by sliding the sliders 30 of three fastener units FU11, FU12, and FU13 formed into a stacked structure along the elements 20 and 20, and the opening-closing ends V11T and V12T in the vertical directions V11 and V12 of uppermost and lowermost fastener units in the case where multiple, for example, three fastener units FU1 are provided as slide fasteners SF1 according to the first embodiment and formed into a stacked structure by coupling the top holding section 20V1R of the first fastener unit FU11 to the bottom holding section 20V2R of the second fastener unit FU12 using the coupling electrode portion REP or subsequently joining them together in a push-in manner and then sequentially coupling the bottom holding section of each new fastener unit FU13 to the top holding section of the previous fastener unit FU12 using a coupling electrode portion or subsequently joining them together in a push-in manner. As illustrated in FIG. 7(2) to FIG. 7(76), there are 75 combination patterns that form an input-output line L12 by connecting the power supply input line L1 and/or the signal input-output line SL to one of the opening-closing ends H1T1, H1T2, and H1T3 in the horizontal direction H1 and the uppermost and lowermost opening-closing ends V11T and V12T in the vertical directions V11 and V11 or by engaging the input electrode section L1P to which the power supply input line L1 and/or the signal input-output line SL is/are connected with the one of the opening-closing ends, and by connecting the power supply output line L2 extending to the powered device DK and/or the signal input-output line SL extending to the powered device DK to another one of the remaining opening-closing ends or engaging the output electrode section L2P to which the power supply output line L2 extending to the powered device DK and/or the signal input-output line SL extending to the powered device DK is/are connected with another one of the remaining opening-closing ends. The combination patterns illustrated in FIG. 7(2) to FIG. 7(76) are examples when three fastener units are formed into a stacked structure as illustrated in FIG. 7(1). However, the number of combination patterns can be similarly calculated in the case where there are a different number of fastener units.

Specifically, when the uppermost opening-closing end V11T in the vertical direction V11 is chosen as an input terminal from among the opening-closing ends H1T1, H1T2, and H1T3 in the horizontal direction H1 and the uppermost and lowermost opening-closing ends V11T and V12T in the vertical directions V11 and V12, there are 15 variations of output terminal/terminals including: four ways in which one of the remaining four opening-closing ends is chosen as an output terminal (FIG. 7(2) to FIG. 7(5)); six ways in which any two of the opening-closing ends are chosen as output terminals in combination (FIG. 7(6) to FIG. 7(11)); four ways in which any three of the opening-closing ends are chosen as output terminals in combination (FIG. 7(12) to FIG. 7(15)); and one way in which the remaining four opening-closing ends are chosen as output terminals (FIG. 7(16)). Similarly, when the lowermost opening-closing end V12T in the vertical direction V12 is chosen as an input terminal, there are 15 variations of output terminal/terminals including: four ways in which one of the remaining four opening-closing ends is chosen as an output terminal (FIG. 7(17) to FIG. 7(20)); six ways in which any two of the opening-closing ends are chosen as output terminals in combination (FIG. 7(21) to FIG. 7(26)); four ways in which any three of the opening-closing ends are chosen as output terminals in combination (FIG. 7(27) to FIG. 7(30)); and one way in which the remaining four opening-closing ends are chosen as output terminals (FIG. 7(31)). When one of the opening-closing ends H1T1, H1T2, and H1T3 in the horizontal direction H1 is chosen as an input terminal, there are similarly 15 variations of output terminal/terminals (FIG. 7(32) to FIG. 7(46), FIG. 7(47) to FIG. 7(61), and FIG. 7(62) to FIG. 7(76)). Thus, there are 75 combinations of input terminal/terminals and output terminal/terminals in total.

In the three fastener units FU11 to FU13 that are formed into a stacked structure by being coupled together using coupling electrode portions or by being subsequently joined together in a push-in manner, the electrodes may be embedded in the fastener tapes 10 of the first and second elements 20 of each of the fastener units FU11 to FU13 arranged so as to face each other, in the end portion of the element-upper-leg portion 20V1, inside the element-upper-leg portion 20V1, in the end portion of the element-lower-leg portion 20V2, and inside the element-lower-leg portion 20V2 in any of the 75 combinations illustrated in FIG. 7(2) to FIG. 7(76). Alternatively, these electrodes may be embedded only in the end portion of the element-upper-leg portion 20V1, inside the element-upper-leg portion 20V1, in the end portion of the element-lower-leg portion 20V2, inside the element-lower-leg portion 20V2, and in the fastener tapes 10, which are opening-closing ends to which the power supply input line L1 and/or the signal input-output line SL and the power supply output line L2 extending to the powered device DK and/or the signal input-output line SL extending to the powered device DK are connected or with which the input electrode section L1P to which the power supply input line L1 and/or the signal input-output line SL is/are connected and the output electrode section L2P to which the power supply output line L2 extending to the powered device DK and/or the signal input-output line SL extending to the powered device DK is/are connected are concurrently engaged, or subsequently joined in a push-in manner, the opening-closing ends being chosen from among the opening-closing ends H1T1, H1T2, and H1T3 in the horizontal direction H1 and the uppermost and lowermost opening-closing ends V11T and V12T in the vertical directions V11 and V12.

Figure 8:
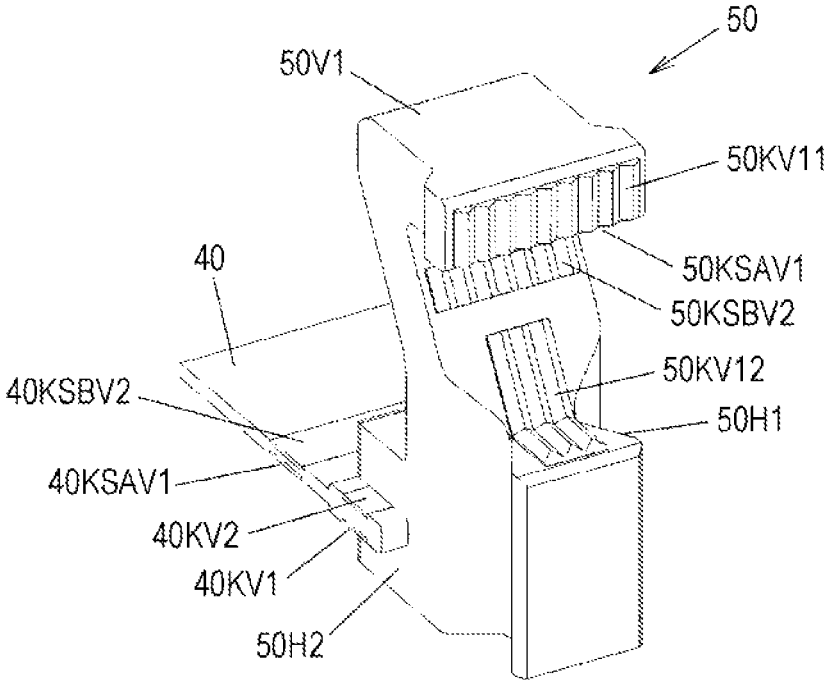
FIG. 8 illustrates an element or elements constituting a slide fastener according to a second embodiment of the present invention where part (a) illustrates a single element and part (b) illustrates elements that face each other.
Figure 8:
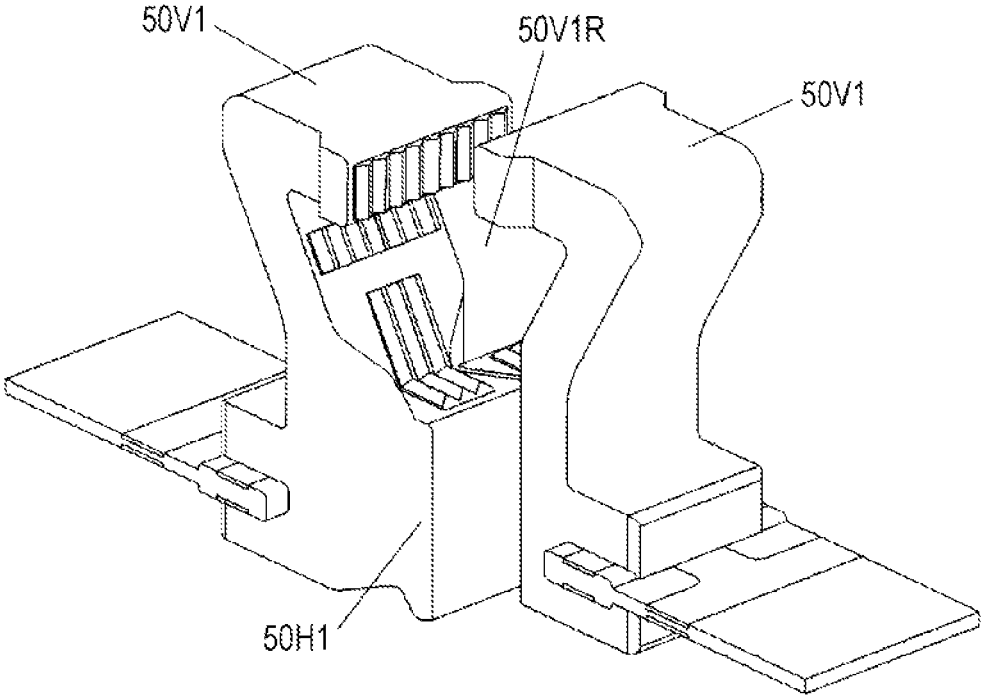

FIG. 8 to FIG. 13 are illustrations related to a slide fastener according to a second embodiment of the present invention. As illustrated in FIG. 8(*a*), each of elements 50 constituting a slide fastener SF4 includes an interlock portion 50H1 on one side in the horizontal direction H5 and a fastener-tape fixing portion 50H2, to which a fastener tape 40 is fixed, on the other side in the horizontal direction H5. Each element 50 also includes an element leg portion 50V1 that extends in one vertical direction V51 with respect to the horizontal direction H5 and the extended portion is bent into a hook shape.

A (positive) power electrode 50KV11 is embedded in an end portion of the element leg portion 50V1 and a (negative) power electrode 50KV12, an electrode 50KSAV1 for a signal A, and an electrode 501KSBV2 for a signal B are embedded in the element leg portion 50V1.

The (positive) power electrode 50KV11 embedded in the end portion of the element leg portion 50V1, and the (negative) power electrode 50KV12, the electrode 50KSAV1 for the signal A, and the electrode 50KSBV2 for the signal B embedded in the element leg portion 50V1 are respectively connected to a (positive) power electrode 40KV1, a (negative) power electrode 40KV2, an electrode 40KSAV1 for the signal A, and an electrode 40KSBV2 for the signal B, which are embedded in a fastener tape 40 fixed to the fastener-tape fixing portion 50H2.

As illustrated in FIG. 8(*b*), elements 50 of this type are arranged so as to face each other. In cooperation with interlock or separation of the interlock portions 50H1 and 50H1 of first and second elements 50 and 50 arranged so as to face each other, end portions of the element-leg portions 50V1 and 50V1 arranged so as to face each other form a holding section 50V1R by coming closer to and becoming separated from each other.

Figure 9:
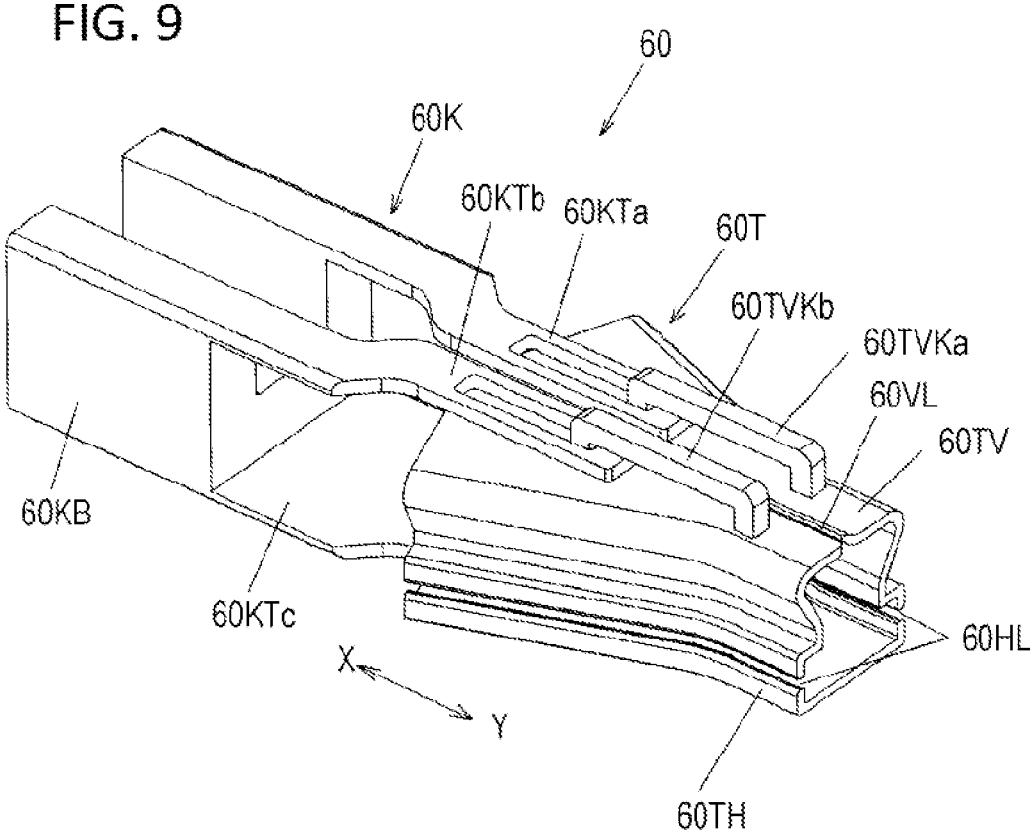
FIG. 9 is a perspective view of a slider constituting the slide fastener according to the second embodiment.

As illustrated in FIG. 9, a slider 60 constituting the slide fastener SF4 includes a slider body 60T, which interlocks and unlocks the elements 50 by causing the elements 50 to pass therethrough, and a tab 60K that moves the slider body 60T. The slider body 60T includes a horizontal activating-side case 60TH and a vertical activating-side case 60TV. Horizontal slits 60HL are formed between the horizontal activating-side case 60TH and the vertical activating-side case 60TV. The horizontal slits 60HL allow the opposing fastener tapes 40, serving as opening-closing ends HT in the horizontal direction H, to pass therethrough. Vertical slits 60VL are formed at the middle of the vertical activating-side case 60TV so as to correspond to an opening-closing end V1T of the one vertical direction V1.

Although not illustrated, a tab horizontal attachment portion 60THK is erectly provided at the middle of the horizontal activating-side case 60TH. Tab vertical attachment portions 600TVKa and 60TVKb are erectly provided to the vertical activating-side case 60TV on both sides of the vertical slit 60VL.

The tab 60K includes attachment portions 60KTa, 60KTb, and 60KTc, which are attached to the slider body 60T, and a tab portion 60KB. The attachment portion 60KTa is attached to the tab horizontal attachment portion 60THK of the horizontal activating-side case 60TH of the slider body 60T and the attachment portions 60KTb and 60KTc are attached to the tab vertical attachment portions 60TVKa and 60TVKb of the vertical activating-side case 60TV of the slider body 60T in such a manner that the slider body 60T is sandwiched between the attachment portions 60KTa and 60KTb and 60KTc from both sides of the slider body 60T. Here, the tab 60K is pulled in the direction of the arrow X to close the slider 60 while the tab 60K is pushed in the direction of the arrow Y to open the slider 60.

Figure 10:
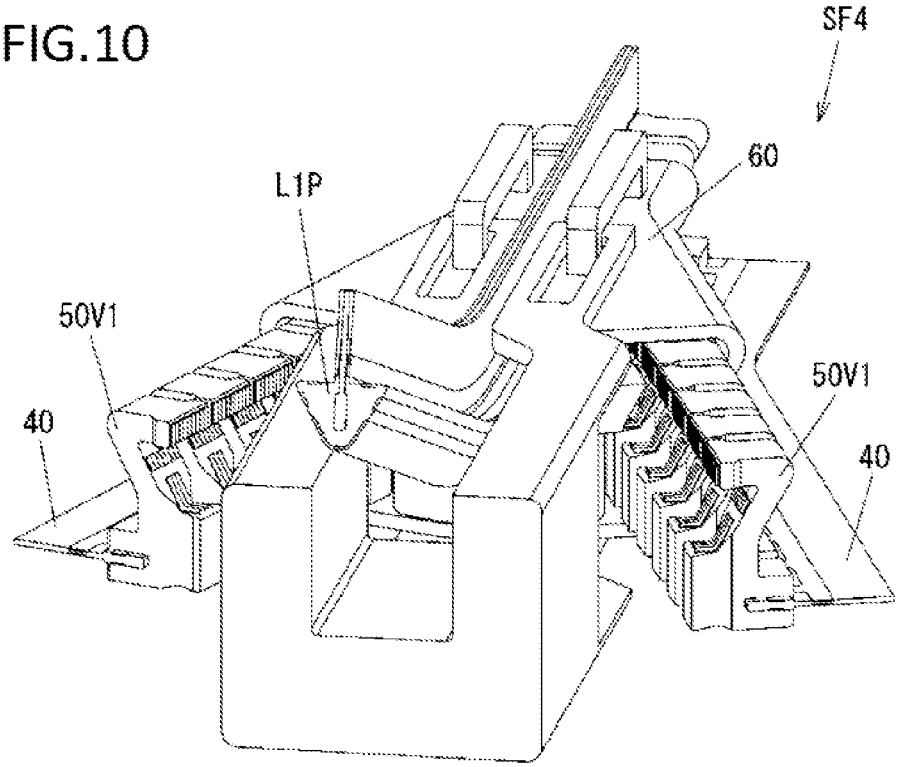
FIG. 10 is a perspective view of the slide fastener according to the second embodiment that forms a power and/or signal input-output line using the elements and the slider of the slide fastener according to the second embodiment.
Figure 11:
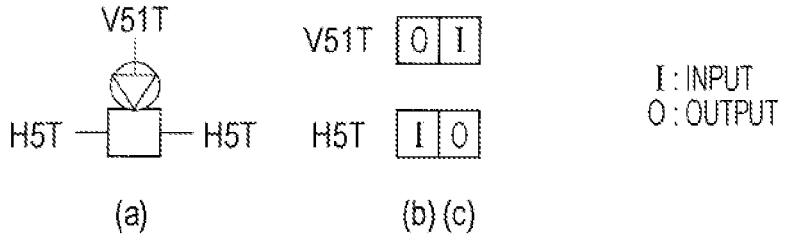
FIG. 11 Part (a) is a schematic diagram illustrating opening-closing ends that open or close as a result of an operation being performed on the slide fastener according to the second embodiment and part (b) and part (c) are diagrams of combination patterns.

FIG. 10 is a perspective view of a slide fastener SF4 that forms a power and/or signal input-output line using elements and a slider of a slide fastener according to the second embodiment. FIG. 11(*a*) is a schematic diagram illustrating opening-closing ends H5T in the horizontal direction H5, which are closed by sliding a slider 60 of the slide fastener SF4 according to the second embodiment along elements 50, and an opening-closing end V51T in the vertical direction V51. In FIG. 10, in the case of a slide fastener in which an element leg portion 50V1 of each element 50 is made of a nonelastic material, a power and/or signal input-output line L12 is formed in the following manner. By sliding the slider 60 along the elements 50 and 50 arranged so as to face one another, the elements 50 and 50 are interlocked to close the opening-closing ends H5T in the horizontal direction H5, which are opposing fastener tapes 40. At the same time, the input electrode section L1P or the output electrode section L2P is concurrently engaged with the holding section 50V1R to close the opening-closing end V51T in the one vertical direction V51. Moreover, the power supply input line L1 and/or the signal input-output line SL is/are connected to one of the opening-closing ends H5T in the horizontal direction H5 and the opening-closing end V51T in the one vertical direction V51 or the input electrode section L1P to which the power supply input line L1 and/or the signal input-output line SL is/are connected is concurrently engaged with the opening-closing end. In addition, the power supply output line L2 extending to the powered device DK and/or the signal input-output line SL extending to the powered device DK is/are connected to another one of the remaining opening-closing ends or the output electrode section L2P to which the power supply output line L2 extending to the powered device DK and/or the signal input-output line SL extending to the powered device DK is/are connected is concurrently engaged with the another one of the remaining opening-closing ends.

Alternatively, in the case of a slide fastener in which the element leg portion 50V1 of each element 50 is made of an elastic material, a power and/or signal input-output line L12 is formed in the following manner. By sliding the slider 60 along the elements 50 and 50 arranged so as to face each other, the elements 50 and 50 are interlocked to close the opening-closing ends H5T in the horizontal direction H5, which are opposing fastener tapes 40, and the input electrode section L1P or the output electrode section L2P is concurrently engaged, or subsequently joined in a push-in manner, with the holding section 50V1R to close the opening-closing end V51T in the one vertical direction V51. Then, the power supply input line L1 and/or the signal input-output line SL is connected to one of the opening-closing ends H5T in the horizontal direction H5 and the opening-closing end in the one vertical directions V51 or the input electrode section L1P to which the power supply input line L1 and/or the signal input-output line SL is/are connected is concurrently engaged, or subsequently joined in a push-in manner, with the opening-closing end. In addition, the power supply output line L2 extending to the powered device DK and/or the signal input-output line SL extending to the powered device DK is/are connected to another one of the remaining opening-closing ends or the output electrode section L2P to which the power supply output line L2 extending to the powered device DK and/or the signal input-output line SL extending to the powered device DK is/are connected is concurrently engaged, or subsequently joined in a push-in manner, with the another one of the remaining opening-closing ends.

As illustrated in FIG. 11(*b*) and FIG. 11(*c*), there are two combination patterns for forming an input-output line L12 illustrated in FIG. 11(*a*) by connecting the power supply input line L1 and/or the signal input-output line SL to one of the opening-closing ends H5T in the horizontal direction H5 and the opening-closing end V51T in the vertical direction V51 or engaging the input electrode section L1P to which the power supply input line L1 and/or the signal input-output line SL is/are connected with the one of the opening-closing ends and by connecting the power supply output line L2 extending to the powered device DK and/or the signal input-output line SL extending to the powered device DK to another one of the remaining opening-closing ends or engaging the output electrode section L2P to which the power supply output line L2 extending to the powered device DK and/or the signal input-output line SL extending to the powered device DK is/are connected with the other one of the remaining opening-closing ends.

Specifically, when the opening-closing ends H5T in the horizontal direction H5 are chosen as input terminals from among the opening-closing ends H5T in the horizontal direction H5 and the opening-closing end V51T in the one vertical direction V51, the opening-closing end V51T in the one vertical direction V51 (FIG. 11(*b*)) is used as the output terminal. When the opening-closing end V51T in the one vertical direction V51 is chosen as an input terminal, the opening-closing ends H5T in the horizontal direction H5 (FIG. 11(*c*)) are used as the output terminals. Thus, there are two combinations of input terminal/terminals and output terminal/terminals.

Figure 12:
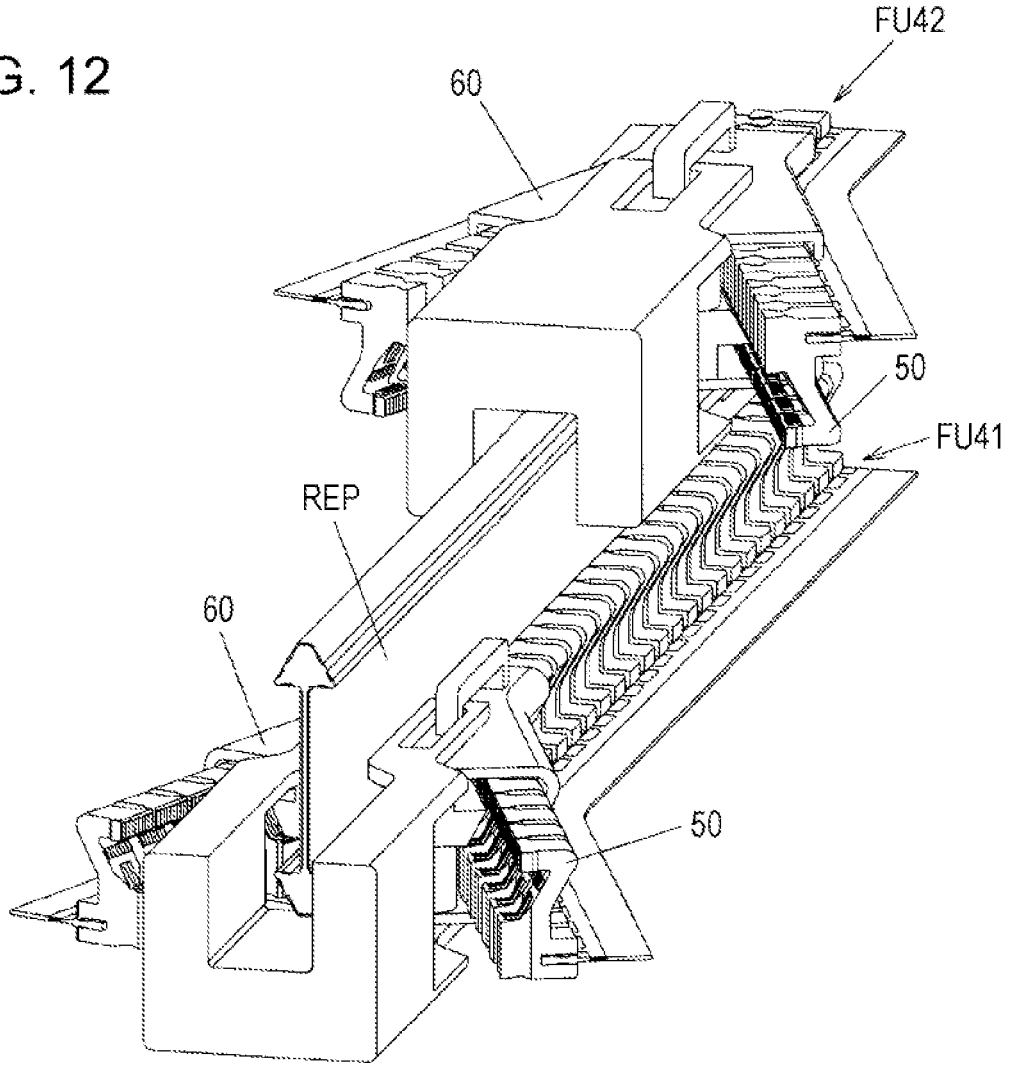
FIG. 12 is a perspective view of slide fasteners formed into a stacked structure by coupling two slide fasteners according to the second embodiment.

FIG. 12 is a perspective view of the case where two slide fasteners SF4 according to the second embodiment, which are fastener units FU4, are formed into a stacked structure by coupling the holding sections 50V1R of the two fastener units FU41 and FU42 using a coupling electrode portion REP. In this drawing, when the two fastener units FU41 and FU42 are both fastener units having an element leg portion made of a nonelastic material, the two fastener units FU41 and FU42 are formed into a stacked structure by coupling the holding sections 50V1R of the two fastener units FU41 and FU42 together in the vertical direction using the coupling electrode portion REP when the opposing elements 50 of the two fastener units FU41 and FU42 are interlocked by sliding the sliders 60 of the two fastener units FU41 and FU42 along the elements 50 of the two fastener units FU41 and FU42.

In the case where at least the fastener unit FU41 of the two fastener units FU41 and FU42 is a fastener unit that has element leg portions made of an elastic material, if the fastener unit FU42 is a fastener unit that has element leg portions made of a nonelastic material, the two fastener units FU41 and FU42 are formed into a stacked structure by coupling the holding sections 50V1R of the fastener units together in the vertical direction using the coupling electrode portion REP when the opposing elements 50 of the fastener unit FU42 having element leg portions made of a nonelastic material are interlocked by sliding the slider 60 of the fastener unit FU42 along the elements 50 of the fastener unit. When the elements of the fastener unit FU41 having element leg portions made of an elastic material are subsequently interlocked, the holding sections 50V1R are concurrently coupled together using a coupling electrode portion REP or subsequently coupled together in a push-in manner in the vertical direction. In the case where the fastener unit FU42 is a fastener unit that has an element leg portion made of an elastic material, the two fastener units FU41 and FU42 are formed into a stacked structure by coupling the holding sections 50V1R of the fastener units having element leg portions made of an elastic material together using the coupling electrode portion REP when the opposing elements 50 of the two fastener units are interlocked by sliding the sliders of the two fastener units along the elements 50 of the two fastener units, or coupling the holding sections 50V1R together in a push-in manner in the vertical direction after the elements 50 have been interlocked.

Figure 13:
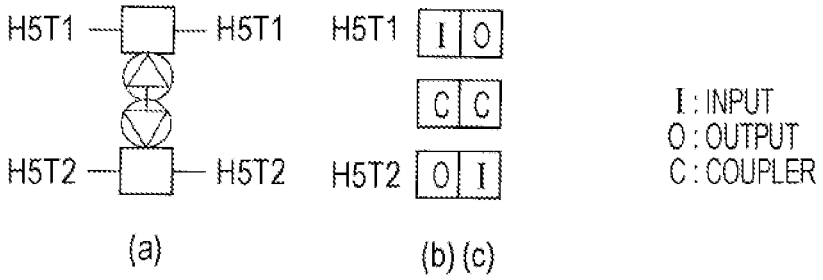
FIG. 13 Part (a) is a schematic diagram illustrating opening-closing ends that open or close as a result of an operation being performed on the slide fasteners formed into a stacked structure by coupling two slide fasteners according to the second embodiment and part (b) and part (c) are diagrams of combination patterns.

FIG. 13(*a*) is a schematic view of the opening-closing ends H5T1 and H5T2 in the horizontal direction H5, which are closed by sliding each slider of two fastener units along the elements arranged so as to face each other, of the two fastener units in the case where two fastener units FU4 are provided as slide fasteners SF4 according to the second embodiment and formed into a stacked structure by coupling the holding sections 50V1R of the two fastener units together using a coupling electrode portion REP. As illustrated in FIG. 13(*b*) and FIG. 13(*c*), there are two combination patterns that form a power and/or signal input-output line L12 by connecting the power supply input line L1 and/or the signal input-output line SL to the opening-closing ends H5T1 in the horizontal direction H5 of one of the fastener units among the opening-closing ends in the horizontal direction H5 of the two fastener units formed into a stacked structure and by connecting the power supply input line L2 extending to the powered device DK and/or the signal input-output line SL extending to the powered device DK to the opening-closing ends H5T1 in the horizontal direction H5 of another one of the fastener units.

Specifically, when the opening-closing ends H5T1 in the horizontal direction H5 of a first one of the fastener units are chosen as input terminals from among the opening-closing ends H5T1 and H5T2 in the horizontal direction H5, the opening-closing ends H5T2 in the horizontal direction H5 of the second fastener unit (FIG. 13(*b*)) are used as output terminals. When the opening-closing ends H5T2 in the horizontal direction H5 of the second fastener unit are chosen as input terminals, the opening-closing ends H5T1 in the horizontal direction H5 of the first fastener unit (FIG. 13(*c*)) are used as output terminals. Thus, there are two combinations of input terminals and output terminals.

Figure 14:
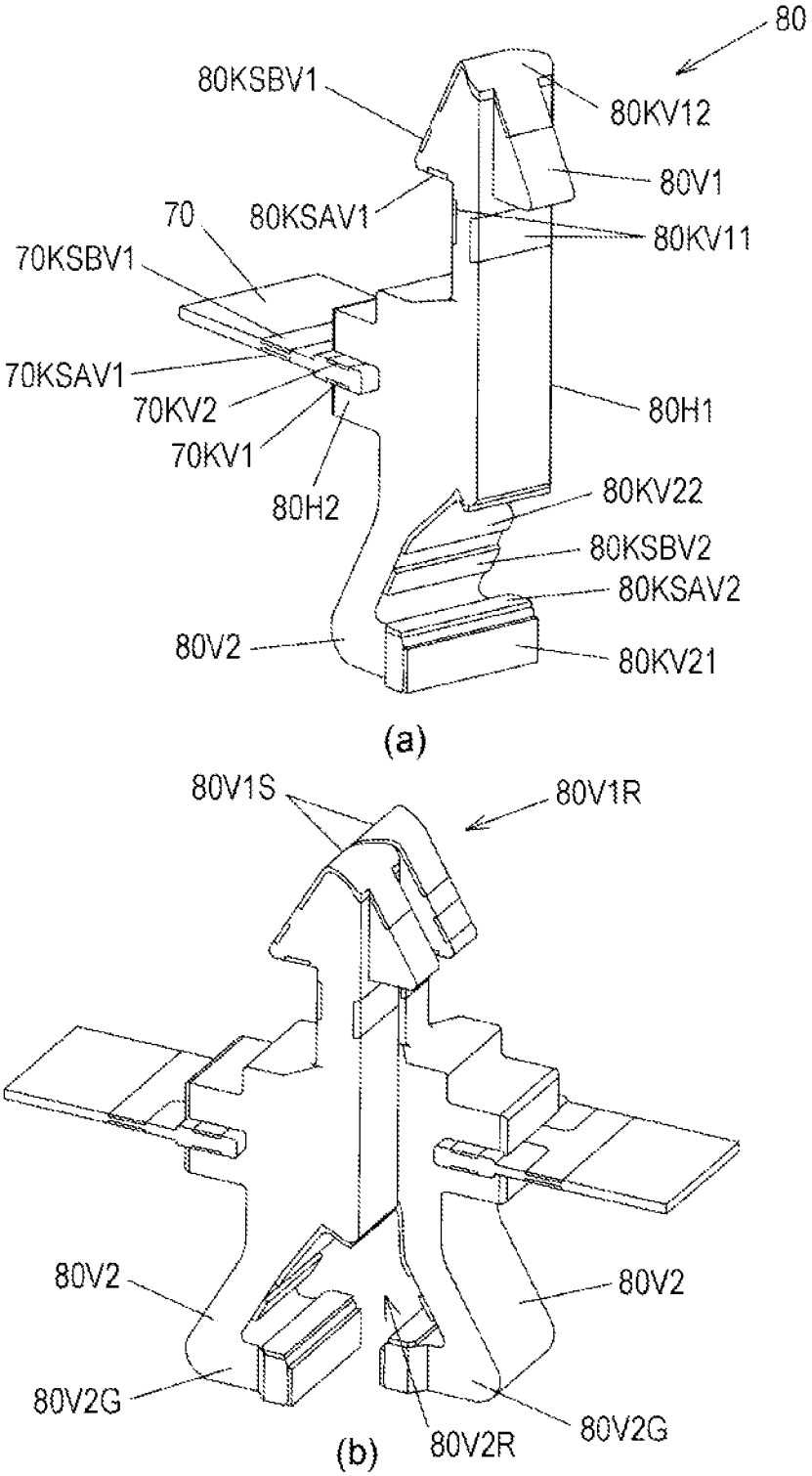
FIG. 14 illustrates an element or elements constituting a slide fastener according to a third embodiment of the present invention where part (a) illustrates a single element and part (b) illustrates elements that face each other.

FIG. 14 to FIG. 17 are illustrations relating to a slide fastener according to a third embodiment of the present invention. As illustrated in FIG. 14(*a*), an element 80 constituting a slide fastener SF7 includes an interlock portion 80H1 on one side in the horizontal direction H8 and a fastener-tape fixing portion 80H2, to which a fastener tape 70 is fixed, on the other side in the horizontal direction H8. The element 80 also includes an element engagement piece 80V1 and an element-engagement-piece receiving piece 80V2. The element engagement piece 80V1 extends in the vertical upward and downward directions V81 and V82 with respect to the horizontal direction H8, and a portion of the element engagement piece 80V1 extended upward is formed into an arrow head shape. A portion of the element-engagement-piece receiving piece 80V2 extended downward is bent into a hook shape.

A (positive) power electrode 80KV11 is embedded in an arrow stick portion of the element engagement piece 80V1 and a (negative) power electrode 80KV12, an electrode 80KSAV1 for a signal A, and an electrode 80KSBV1 for a signal B are embedded in an arrow head portion. In addition, a (positive) power electrode 80KV21 is embedded in an end portion of the element-engagement-piece receiving piece 80V2 and a (negative) power electrode 80KV22, an electrode 80KSAV2 for a signal A, and an electrode 80KSBV2 for a signal B are embedded inside the element-engagement-piece receiving piece 80V2.

The (positive) power electrode 80KV11 embedded in the arrow stick portion of the element engagement piece 80V1, the (negative) power electrode 80KV12, the electrode 80KSAV1 for a signal A, and the electrode 80KSBV1 for a signal B embedded in the arrow head portion, the (positive) power electrode 80KV21 embedded in the end portion of the element-engagement-piece receiving piece 80V2, and the (negative) power electrode 80KV22, the electrode 80KSAV2 for a signal A, and the electrode 80KSBV2 for a signal B embedded inside the element-engagement-piece receiving piece 80V2 are electrically connected together inside the interlock portion 80H1 or along the surface of the interlock portion 80H1 and further respectively connected to a (positive) power electrode 70KV1, a (negative) power electrode 70KV2, an electrode 70KSAV1 for a signal A, and an electrode 70KSBV1 for a signal B, which are embedded in the fastener tape 70 fixed to the fastener-tape fixing portion 80H2.

As illustrated in FIG. 14(*b*), elements 80 of this type are arranged so as to face each other. By interlocking the interlock portions 80H1 and 80H1 of first and second elements 80 and 80 arranged so as to face each other, the element engagement pieces 80V1 and 80V1 of the elements 80 and 80 arranged so as to face each other form an element engagement portion 80V1R and the element-engagement-piece receiving pieces 80V2 and 80V2 of the elements 80 and 80 facing each other form an element-engagement-portion receiving portion 80V2R. The element engagement portion 80V1R has an arrow head shape having peak portions 80V1S at the tip. The element-engagement-portion receiving portion 80V2R has an arrow-head receivable shape in which portions of the element-engagement-piece receiving pieces 80V2 and 80V2 extended downward are formed into hook shapes 80V2G and 80V2G and the arrow-head-shaped element engagement portion 80V1R can be engaged with the element-engagement-portion receiving portion 80V2R.

Figure 15:
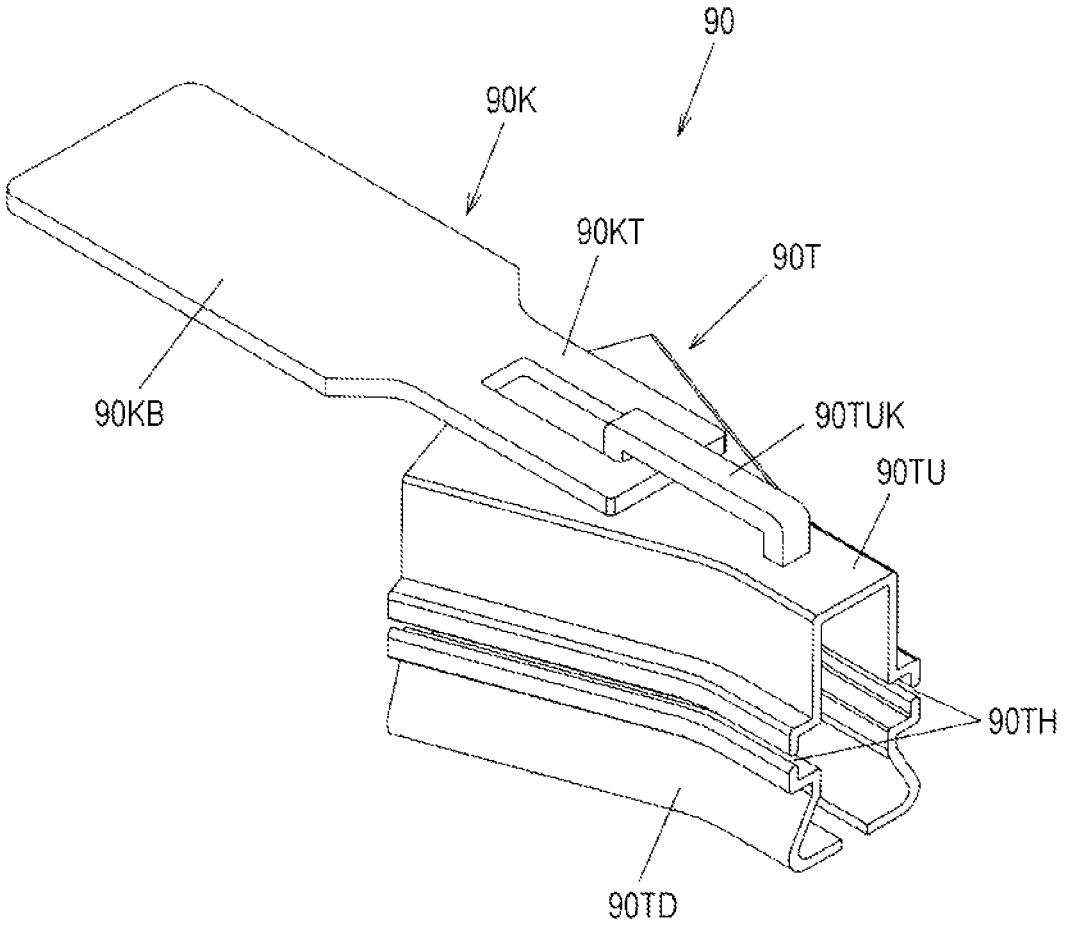
FIG. 15 is a perspective view of a slider constituting the slide fastener according to the third embodiment.

As illustrated in FIG. 15, a slider 90 constituting the slide fastener SF7 includes a slider body 90T, which interlocks and unlocks the elements 80 by causing the elements 80 to pass therethrough, and a tab 90K, which moves the slider body 90T. The slider body 90T includes an upper-vertical-side case 90TU and a lower-vertical-side case 90TD. The slider body 90T also has horizontal slits 90TH, through which the fastener tapes 70 pass, between the upper-vertical-side case 90TU and the lower-vertical-side case 90TD.

The tab 90K includes an attachment portion 90KT, which is attached to the slider body 90T, and a tab portion 90KB. The attachment portion 90KT is engaged with a tab attachment portion 90TUK erectly provided on the upper-vertical-side case 90TU.

Figure 16:
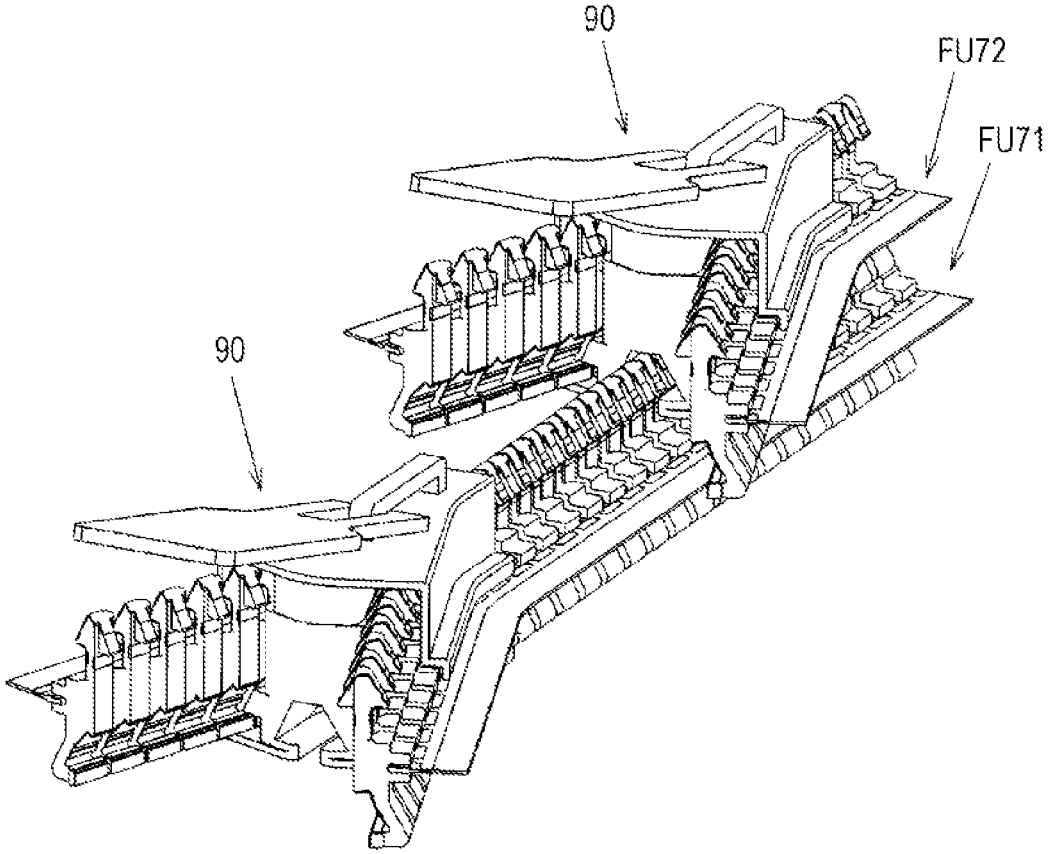
FIG. 16 is a perspective view of slide fasteners formed into a stacked structure by coupling multiple slide fasteners according to the third embodiment, the slide fasteners forming a power and/or signal input-output line.

FIG. 16 is a perspective view of slide fasteners that form a power and/or signal input-output line in the case where multiple slide fasteners SF7 according to the third embodiment are used as fastener units FU7 and formed into a stacked structure by engaging the element engagement portion 80V1R of a first fastener unit FU71, which has been formed by interlocking the interlock portions 80H1 of the elements 80, with the element-engagement-portion receiving portion 80V2R of a second fastener unit FU72 and thus sequentially engaging the element engagement portion of the previous fastener unit with the element-engagement-portion receiving portion of each new fastener unit. In the third embodiment, one side portion of each element 80 functions as an element engagement portion 80V1R. Thus, no coupling electrode portion is needed to form the fastener units FU7 into a stacked structure.

In this drawing, in the case where one of multiple fastener units that includes element-engagement-piece receiving pieces 80V2 made of a nonelastic material is connected to the other fastener units in a stacked manner, the multiple fastener units are connected to each other in a stacked manner by, when the elements 80 and 80 of each fastener unit are interlocked by sliding the slider 90 of the fastener unit along the elements 80 and 80 of the fastener unit, engaging the engagement portion 80V1R of the first fastener unit FU71, which has been formed by interlocking the interlock portions 80H1, with the element-engagement-portion receiving portion 80V2R of the second fastener unit FU72 made of a nonelastic material and then sequentially engaging the element engagement portion 80V1R of the previous fastener unit with the element-engagement-portion receiving portion 80V2R of each new fastener unit. Then, a power and/or signal input-output line L12 is formed by connecting the power supply input line L1 and/or the signal input-output line SL to any one of the opening-closing ends H8T in the horizontal direction H8 of multiple fastener units and the opening-closing end V81T of the engagement-portion receiving portion of the lowermost fastener unit or engaging the input electrode section L1P to which the power supply input line L1 and/or the signal input-output line SL is/are connected with the one of the opening-closing ends and connecting the power supply output line L2 extending to the powered device DK and/or the signal input-output line SL extending to the powered device DK to another one of the remaining opening-closing ends or engaging the output electrode section L2P to which the power supply output line L2 extending to the powered device DK and/or the signal input-output line SL is connected with another one of the remaining opening-closing ends.

When a fastener unit including element-engagement-piece receiving pieces 80V2 made of an elastic material among multiple fastener units is connected to the other fastener units in a stacked manner, the multiple fastener units are connected together in a stacked manner by, when the elements 80 and 80 of the fastener units are interlocked by sliding the sliders 90 of the fastener units along the elements 80 and 80 of the fastener units, engaging the element engagement portions 80V1R of the first fastener unit FU71, which have been formed by interlocking the interlock portions 80H1, with the element-engagement-portion receiving portions 80V2R of the second fastener unit FU72 made of an elastic material and concurrently engaging, or subsequently joining in a push-in manner, the element engagement portions 80V1R of the previous fastener unit with the element-engagement-portion receiving portions 80V2R of each new fastener unit in a sequential manner. Then, a power and/or signal input-output line L12 is formed in the following manner. The power supply input line L1 and/or the signal input-output line SL is/are connected to one of the opening-closing ends H8T in the horizontal direction H8 of the multiple fastener units and the opening-closing end V81T of the engagement-portion receiving portion of the lowermost fastener unit or the input electrode section L1P to which the power supply input line L1 and/or the signal input-output line SL is/are connected is engaged, or joined in a push-in manner, with the opening-closing end. In addition, the power supply output line L2 extending to the powered device DK and/or the signal input-output line SL extending to the powered device DK is/are connected to another one of the remaining opening-closing ends or the output electrode section L2P to which the power supply output line L2 extending to the powered device DK and/or the signal input-output line SL extending to the powered device DK is/are connected is engaged, or joined in a push-in manner, with another one of the remaining opening-closing ends.

Figure 17:
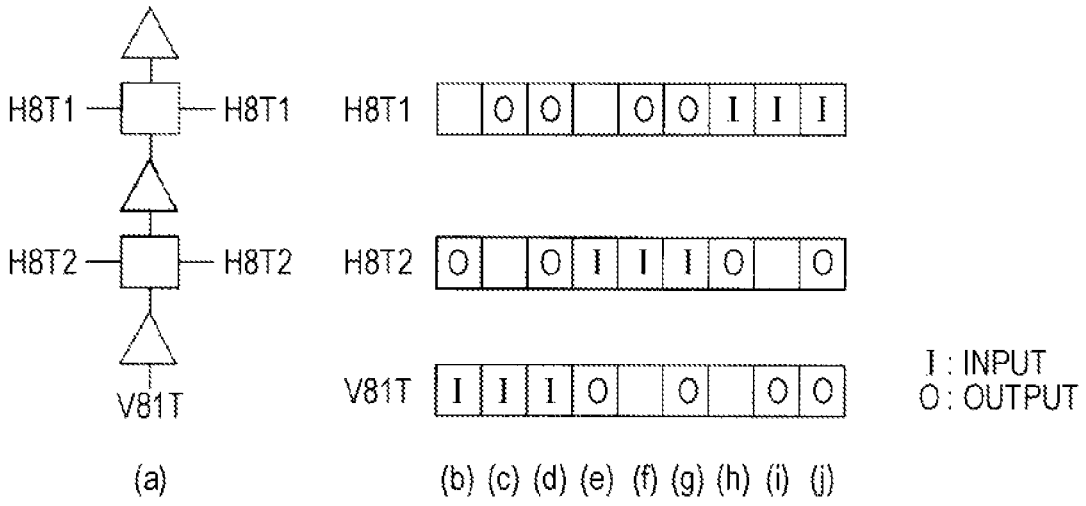
FIG. 17 Part (a) is a schematic diagram illustrating opening-closing ends that open or close as a result of an operation being performed on slide fasteners formed into a stacked structure by coupling multiple slide fasteners according to the third embodiment and part (b) to part (j) are diagrams of combination patterns.

FIG. 17(*a*) is a schematic view of the opening-closing ends H8T1 and H8T2 in the horizontal direction H8 and the opening-closing end V8T of the engagement-portion receiving portion of the lowermost fastener unit, which are closed by sliding the sliders 90 of multiple fastener units along the elements 80 and 80, in the case where slide fasteners SF7 according to the third embodiment are provided as multiple fastener units FU7 and formed into a stacked structure by engaging the element engagement portions 80V1R of the first fastener unit FU71, which have been formed by interlocking the interlock portions 80H1 of the elements 80, with the element-engagement-portion receiving portions 80V2R of the second fastener unit FU72 and thus sequentially engaging the element engagement portions of the previous fastener unit with the element-engagement-portion receiving portions of each new fastener unit. In the case, for example, where two fastener units FU71 and FU72 are formed into a stacked structure, as illustrated in FIG. 17(*b*) to FIG. 17(*j*), there are nine combination patterns that form a power and/or signal input-output line L12 by connecting the power supply input line L1 and/or the signal input-output line SL to one of the opening-closing ends H8T1 and H8T2 in the horizontal direction H8 and the opening-closing end V8T of the engagement-portion receiving portions of the lowermost fastener unit or by engaging, or joining in a push-in manner, the input electrode section L1P to which the power supply input line L1 and/or the signal input-output line SL is/are connected with the one of the opening-closing ends and by connecting the power supply output line L2 extending to the powered device DK and/or the signal input-output line SL extending to the powered device DK to another one of the opening-closing ends or engaging, or joining in a push-in manner, the output electrode section L2P to which the power supply output line L2 extending to the powered device DK and/or the signal input-output line SL extending to the powered device DK is/are connected with another one of the opening-closing ends.

Specifically, when the opening-closing ends H8T1 in the horizontal direction are chosen as input terminals from among the opening-closing ends H8T1 and H8T2 in the horizontal direction and the opening-closing end V8T of the engagement-portion receiving portions of the lowermost fastener unit, there are three variations of output terminal/terminals including: two ways in which one of the remaining two opening-closing ends is used as an output terminal (FIG. 17(*b*) to FIG. 7(*c*)); and one way in which the remaining two opening-closing ends are used as output terminals in combination (FIG. 17(*d*)). Similarly, when the other opening-closing ends H8T2 in the horizontal direction are chosen as input terminals, there are three variations of output terminal/terminals including: two ways in which one of the remaining two opening-closing ends is used as an output terminal (FIG. 17(*e*) to FIG. 7(*f*)); and one way in which the remaining two opening-closing ends are used as output terminals in combination (FIG. 17(*g*)). In addition, when the opening-closing end V8T of the engagement-portion receiving portions of the lowermost fastener unit is chosen as an input terminal, there are three variations of output terminal/terminals including: two ways in which one of the remaining two opening-closing ends is used as an output terminal (FIG. 17(*h*) to FIG. 7(*i*)); and one way in which the remaining two opening-closing ends are used as output terminals in combination (FIG. 17(*j*)). Thus, there are nine combinations of input terminal/terminals and output terminal/terminals in total.

The electrodes may be embedded in the fastener tapes 70, the element engagement pieces 80V1, and the element-engagement-piece receiving pieces 80V2 in any of the nine combinations illustrated in FIG. 17(*b*) to FIG. 17(*j*). Alternatively, these electrodes may be embedded only in: the opposing fastener tapes; and element engagement pieces and element-engagement-piece receiving pieces that are connected together in a stacked manner or with which the input electrode section to which the power supply input line and/or the signal input-output line is/are connected and the output electrode section to which the power supply output line extending to the powered device and/or the signal input-output line extending to the powered device is/are connected are engaged, the opposing fastener tapes and the connected element engagement pieces and element-engagement-piece receiving pieces being opening-closing ends to which the power supply input line and/or the signal input-output line or the power supply output line extending to the powered device and/or the signal input-output line extending to the powered device to the powered device is/are connected, and the element engagement pieces and element-engagement-piece receiving pieces being included in the element engagement portions and the element-engagement-portion receiving portions of multiple fastener units formed into a stacked structure.

Figure 18:
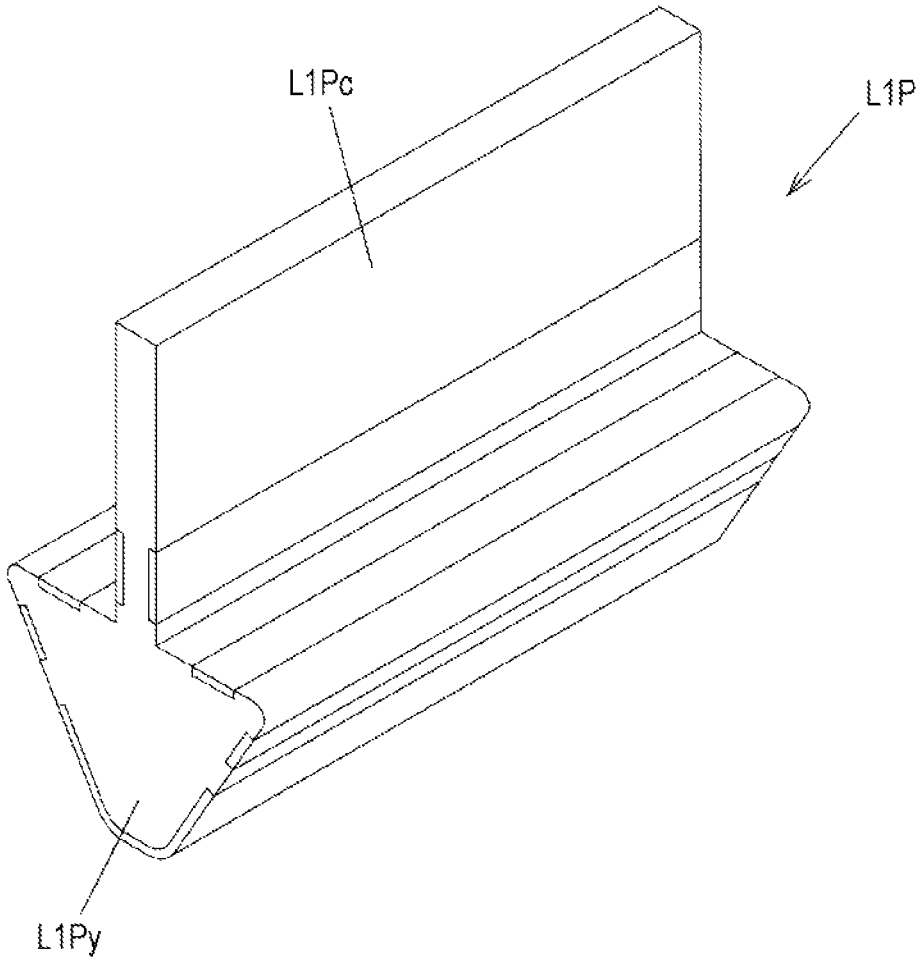
FIG. 18 is a perspective view illustrating an example of an input electrode section to which an input line according to each embodiment is connected.

FIG. 18 to FIG. 22 are illustrations relating to an input electrode section, an output electrode section, and/or a coupling electrode portion, used in common in the embodiments described above. FIG. 18 illustrates an example of the input electrode section L1P. The input electrode section L1P includes an arrow-head-shaped electrode portion L1Py and a connecting portion L1Pc. Besides the (negative) power electrode, an electrode for a signal A and an electrode for a signal B, which transmit and receive various types of signals, are embedded in the electrode portion L1Py. The (positive) power electrodes are embedded on both sides of the connecting portion L1Pc and connected to the power supply unit PU (not illustrated) and the signal unit SU (not illustrated) disposed on an input side.

Figure 19:
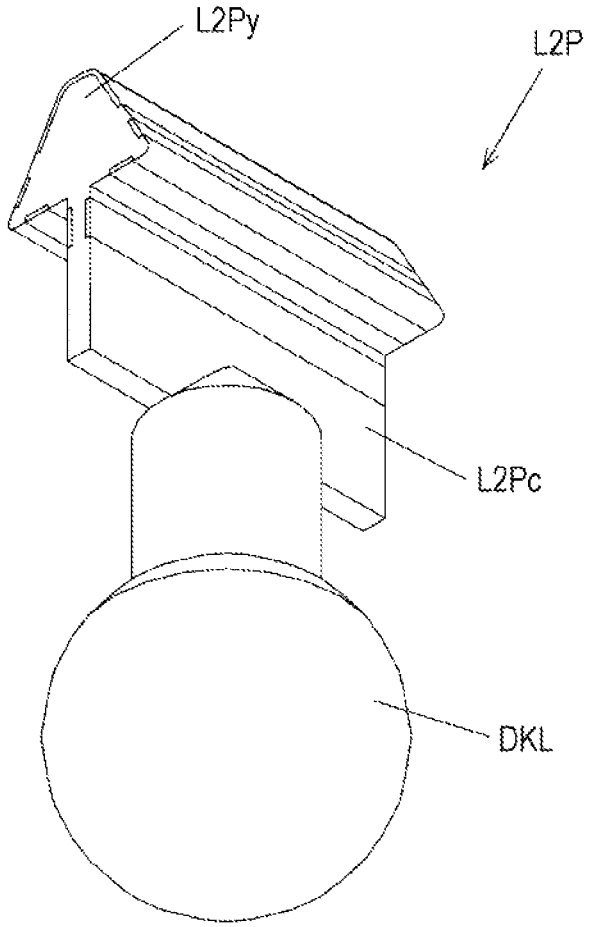
FIG. 19 is a perspective view according to each embodiment illustrating an example of an output electrode section to which an output line to the powered device is connected.

FIG. 19 illustrates an example of the output electrode section L2P. The output electrode section L2P includes an arrow-head-shaped electrode portion L2Py and a connecting portion L2Pc. Besides the (positive) power electrode and the (negative) power electrode, an electrode for a signal A and an electrode for a signal B, which transmit and receive various types of signals, are embedded in the electrode portion L2Py. The connecting portion L2Pc is connected to a lighting device DKL, serving as a powered device, disposed on an output side.

Figure 20:
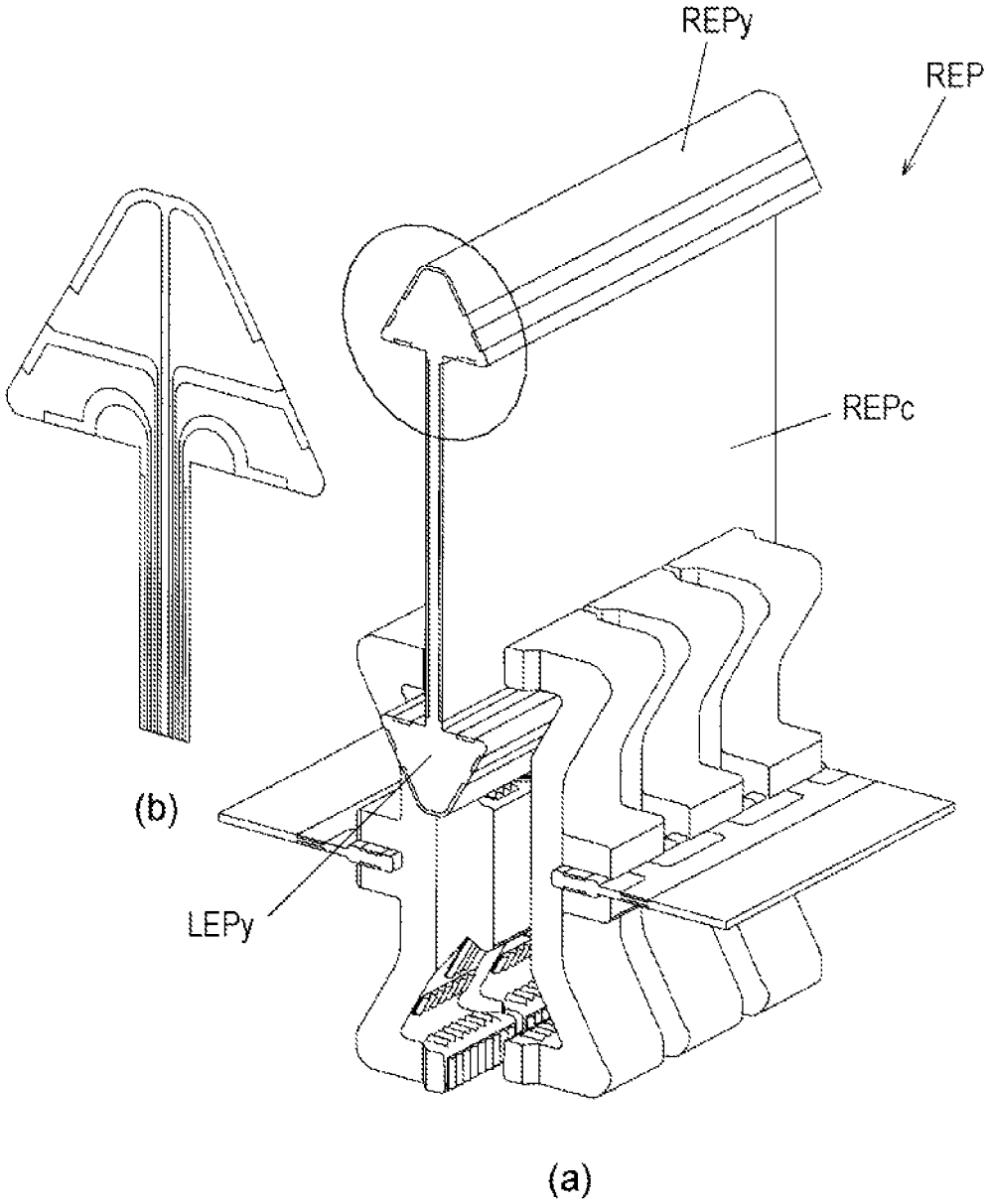
FIG. 20 illustrates an example of a coupling electrode portion used for coupling multiple slide fasteners according to each of the first embodiment and the second embodiment into a stacked structure where part (a) is a perspective view of the coupling electrode portion and part (b) is a diagram in which part of the coupling electrode portion is enlarged.
Figure 21:
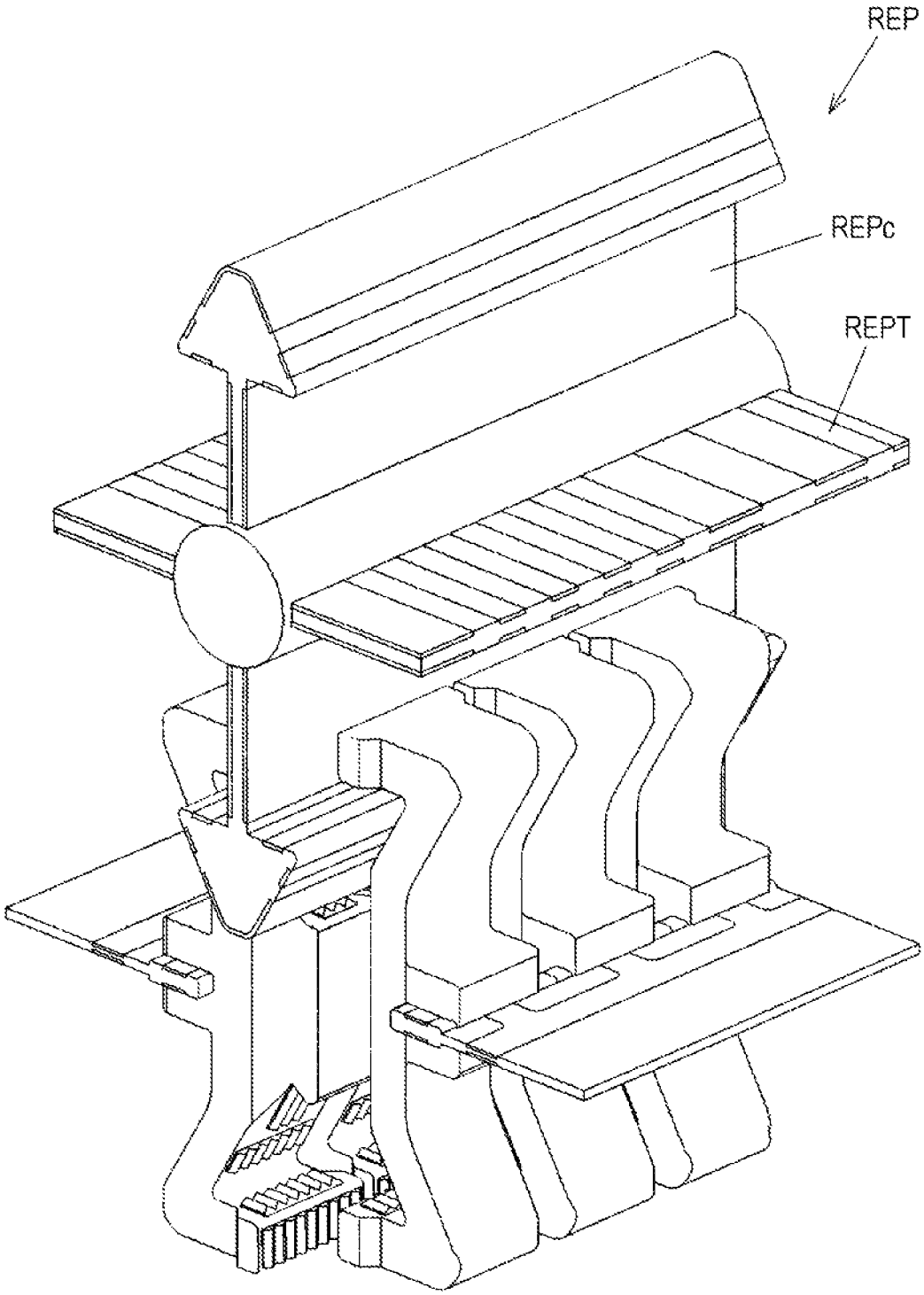
FIG. 21 is also a perspective view of another example of a coupling electrode portion.
Figure 22:
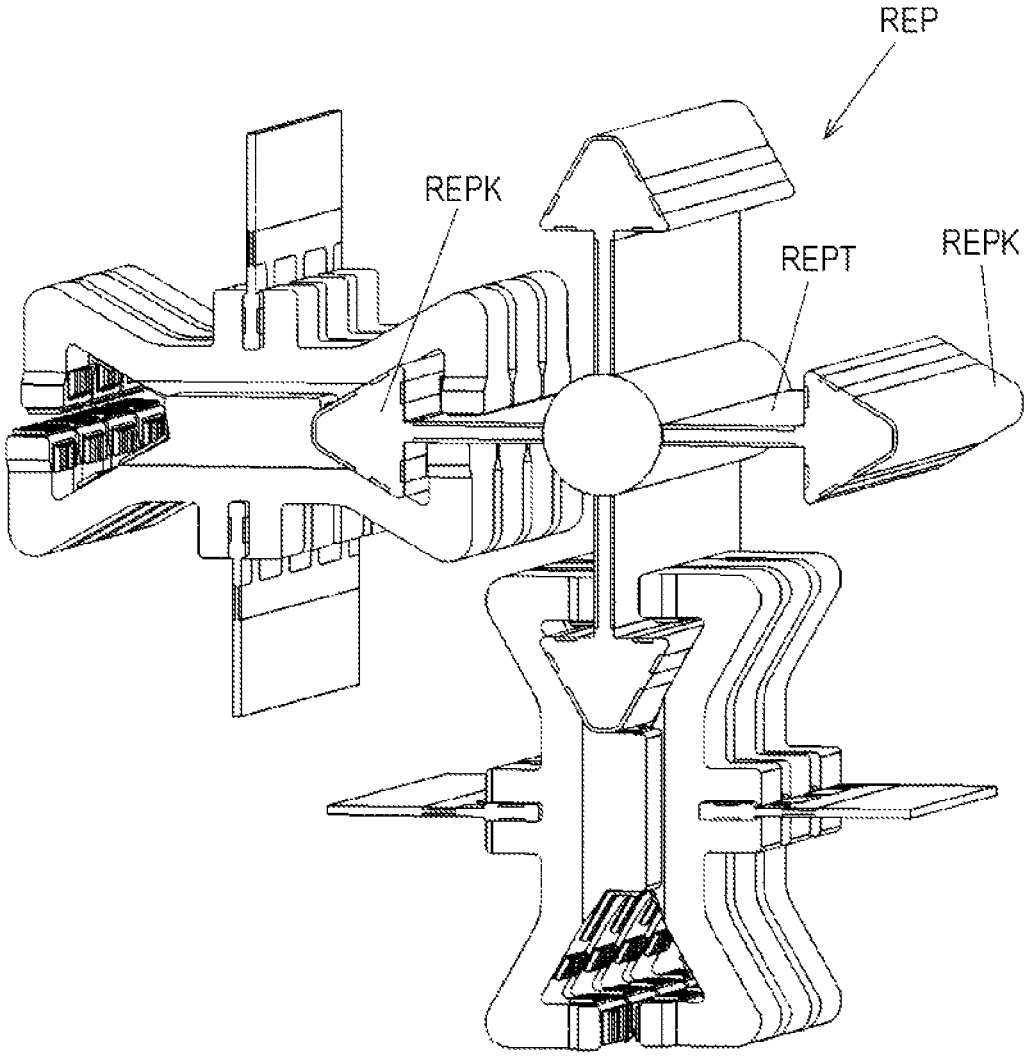
FIG. 22 is also a perspective view of another example of a coupling electrode portion.

FIG. 20 to FIG. 22 illustrate examples of coupling electrode portions REP used in the first embodiment and the second embodiment for coupling multiple slide fasteners together to form a stacked structure. As illustrated in FIG. 20(*a*) for example, the coupling electrode portion REP includes arrow-head-shaped electrode portions REPy on both ends, which are connected together by a coupling portion REPc. FIG. 20(*b*) is an enlarged view of an arrow-head-shaped electrode portion REPy. FIG. 21 and FIG. 22 illustrate other examples of the coupling electrode portions. As illustrated in FIG. 21, an external input-output terminal REPT may be provided from a middle portion of the coupling portion REPc to enable multipoint connection to an input power supply unit, an output external powered device, and an input-output line. Furthermore, as illustrated in FIG. 22, electrode portions REPK may be additionally provided to the external input-output terminal REPT to enable multipoint connection to other slide fasteners.

Conceivable examples of the powered device DK include a lighting device DKL, a surveillance camera DKM, a microphone, a loudspeaker, a fire detector DKQ, a wireless LAN relay device DKC, an electric fan, a battery charger, a clock, a bar code reader, an infrared sensor (a human sensor), a security sensor (a glass breakage or intrusion alarming proximity sensor), an information display terminal (a digital signage), and a photovoltaic power generating panel. In the case where the powered device DK is a lighting device DKL, the lighting device DKL can broadcast or individually transmit control signals of lighting-on, lighting-off, blinking, and lighting-on-and-off patterns if identification information or an address is previously set to the lighting device DKL. Another powered device is also conceivable that only receives power supply from a slide fastener and receives control signals in a wireless manner.

Figure 23:
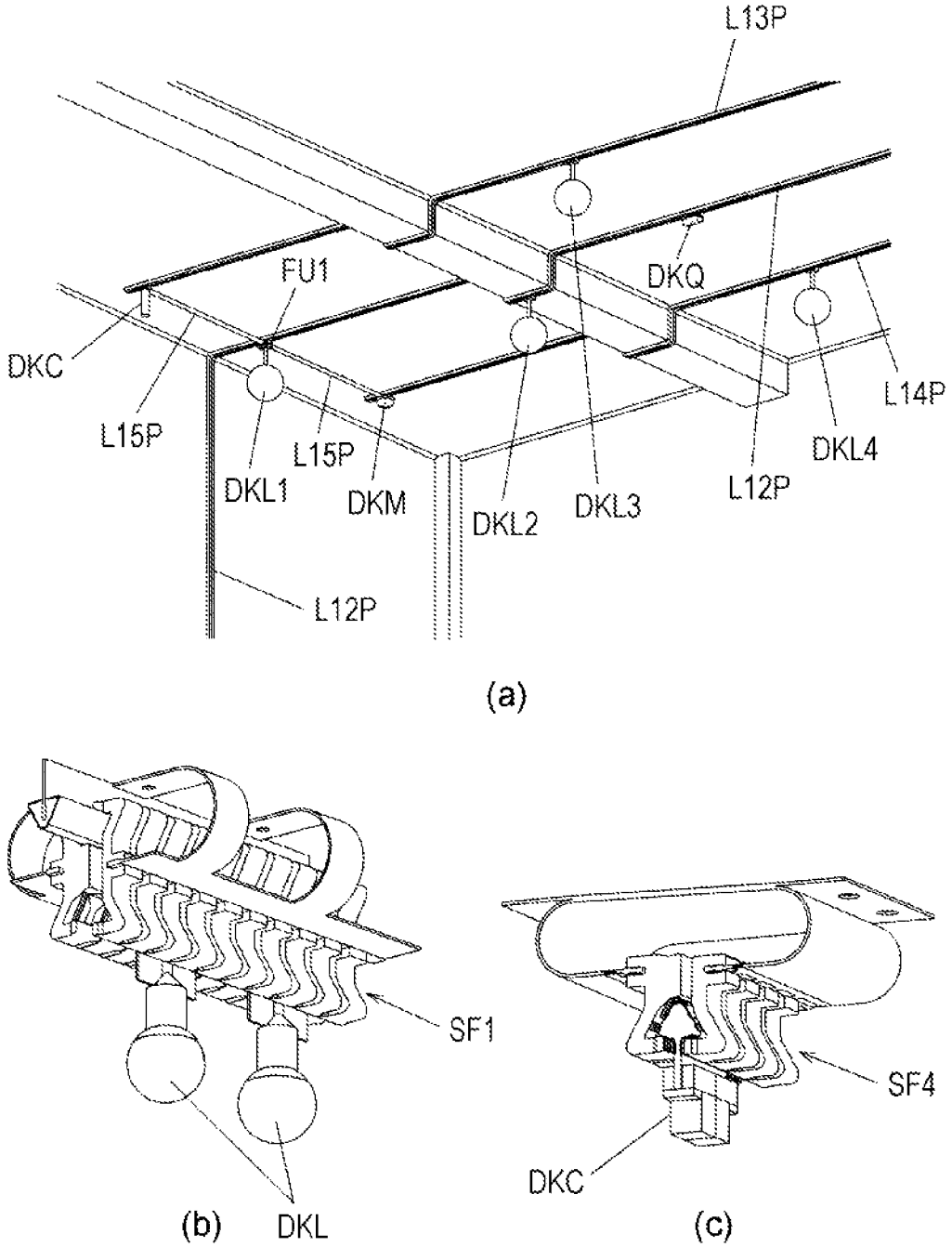
FIG. 23 Part (a) illustrates a specific case where a power and/or signal input-output line formed by using the slide fastener according to each embodiment is stretchably provided to a ceiling of a building, part (b) is a detailed illustration of a slide fastener to which a lighting device, serving as a powered device, is connected, and part (c) is a detailed illustration of a slide fastener to which a wireless LAN relay device, serving as a powered device, is connected.
Figure 24:
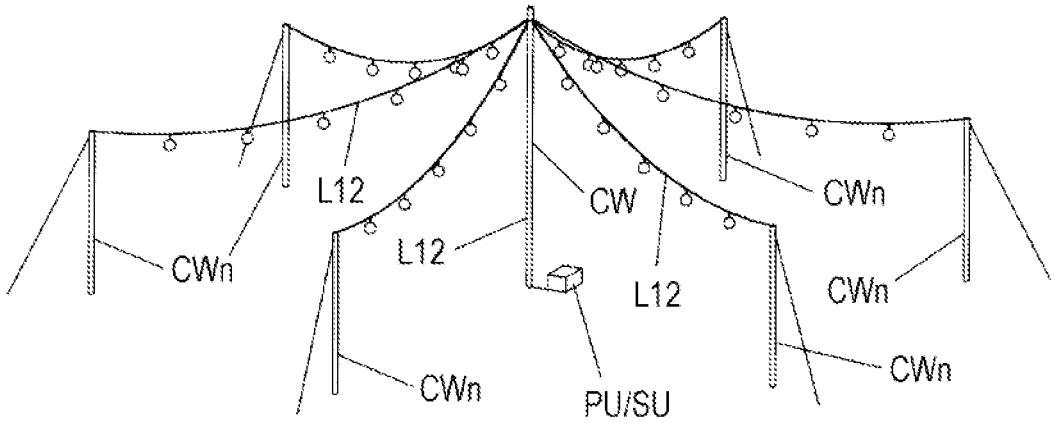
FIG. 24 Part (a) illustrates a specific case where power and/or signal input-output lines formed by using the slide fasteners according to each embodiment are stretchably provided from a standing pole in such a manner as to suspend ropes in the air and part (b) is a detailed illustration of a lighting device, serving as a powered device, connected to a power and/or signal input-output line.
Figure 24:
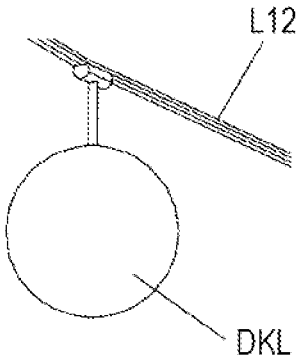

Now, an example of use of a power and/or signal input-output line formed by a closing operation of a slide fastener according to the present invention is described in which the power and/or signal input-output line is/are stretchably provided to a ceiling in a building, a wall, an outer wall of a building, or a roadside tree, or radially from a standing pole in such a manner as to stretch a rope. FIG. 23(*a*) illustrates a specific example in which power and/or signal input-output lines formed by using slide fasteners according to each embodiment are stretchably provided to a ceiling of a building. FIG. 23(*b*) is a detailed illustration of a slide fastener to which lighting devices, serving as powered devices, are connected. FIG. 23(*c*) is a detailed illustration of a slide fastener to which a wireless LAN relay device, serving as a powered device, is connected. FIG. 24(*a*) illustrates a specific example in which power and/or signal input-output lines formed by using slide fasteners according to each embodiment are stretchably provided from a standing pole in such a manner as to suspend ropes in the air. FIG. 24(*b*) is a detailed illustration of a lighting device, serving as a powered device, connected to one power and/or signal input-output line.

FIG. 23(*a*) illustrates a specific example of power and/or signal input-output lines formed by using slide fasteners according to each embodiment in which the power and/or signal input-output lines are stretchably provided to a ceiling of a building. Multiple power supply lines L12P, L13P, and L14P formed by slide fasteners SF1, SF4, and SF7 according to each embodiment are stretched along a ceiling of a building. An end of the power supply line L12P is connected to a power supply unit PU (not illustrated). In the case where the slide fasteners SF1 according to the first embodiment or the slide fasteners SF4 according to the second embodiment are used, the power supply lines L13P and L14P are coupled together via coupling lines L15P, which are branched to both sides from a fastener unit FU1 of multiple fastener units formed into a stacked structure using a coupling electrode portion REP. Power is supplied to the power supply lines L13P and L14P through the power supply line L12P, thereby activating the powered devices DK. In the case where the slide fasteners SF7 according to the third embodiment are used, multiple fastener units can be formed into a stacked structure without using coupling electrode portions. Thus, the power supply lines L13P and L14P are coupled together via coupling lines L15P, which are branched to both sides from the fastener unit FU1 among multiple fastener units formed into a stacked structure. Power is supplied to the power supply lines L13P and L14P through the power supply line L12P, thereby activating the powered devices DK. As examples of the powered devices DK, lighting devices DKL1 and DKL2 and a fire alarm DKQ are connected to the power supply line L12P, a wireless LAN relay device DKC and a lighting device DKL3 are connected to the power supply line L13P, and a surveillance camera DKM and a lighting device DKL4 are connected to the power supply line L14P.

FIG. 23(*b*) is a detailed illustration of a slide fastener SF to which lighting devices DKL, serving as powered devices DK, are connected. The slide fastener SF1 according to the first embodiment is used as the slide fastener. FIG. 23(*c*) is a detailed illustration of a slide fastener SF to which a wireless LAN relay device DKC, serving as a powered device DK, is connected. The slide fastener SF4 according to the second embodiment is used as the slide fastener.

FIG. 24(*a*) illustrates a specific example in which power and/or signal input-output lines formed by using slide fasteners according to each embodiment are stretchably provided radially from a standing pole in such a manner as to stretch ropes. A power and/or signal input-output line L12 formed by a slide fastener SF is installed on a pole CW standing in the center. The end of the power and/or signal input-output line L12 is connected to a power supply unit PU and/or a signal unit SU. Power and/or signal input-output lines L12 are radially stretched from the pole CW standing in the center to multiple poles CWn installed around the center pole CW in such a manner as to stretch ropes. Thus, power and/or signals is/are supplied by a closing operation of the slide fasteners SF.

FIG. 24(*b*) is a detailed illustration of a lighting device DKL, serving as a powered device DK, connected to the power and/or signal input-output line L12. Not only power from the power unit PU, but also control signals of lighting-on, lighting-off, blinking, and lighting-on-and-off patterns are concurrently or individually transmittable from the signal unit SU to the lighting device DKL if identification information or an address has previously been set to the lighting device DKL. Another powered device is also conceivable that only receives power supply from a slide fastener and receives control signals in a wireless manner.

As is clear from the above description, according to a slide fastener of the present invention, an input-output line that activates a powered device can be formed by a closing operation of a slide fastener including uniquely shaped elements, the input-output line being stretchable along a ceiling in a building, a wall, an outer wall of a building, or a roadside tree, or radially from a standing pole in such a manner as to stretch a rope. Thus, places at which the powered device is installed are not limited and the power device that has been installed may be moved to and used at another place.

REFERENCE SIGNS LIST

SF slide fastener
PU power supply unit
SU signal unit
DK powered device
DKL lighting device
DKM surveillance camera
DKQ fire alarm
DKC wireless LAN relay device
L1P input electrode section
L2P output electrode section
REP coupling electrode portion
L1 power supply input line
L2 power supply output line
SL signal input-output line
L12 power and/or signal input-output line
SF1 slide fastener (first embodiment)
FU1 fastener unit
H1T opening-closing end in horizontal direction
V11T opening-closing end in vertical upward direction
V12T opening-closing end in vertical downward direction
10 fastener tape
20 element
20H1 interlock portion
20H2 fastener-tape fixing portion
20V1 element-upper-leg portion
20V2 element-lower-leg portion
20V1R top holding section
20V2R bottom holding section
30 slider
30T slider body
30K tab
SF4 slide fastener (second embodiment)
FU4 fastener unit
H5T opening-closing end in horizontal direction
V51T opening-closing end in one vertical direction
40 fastener tape
50 element
50H1 interlock portion
50H2 fastener-tape fixing portion
50V1 element leg portion
50V1R holding section
60 slider
60T slider body
60K tab
SF7 slide fastener (third embodiment)
FU7 fastener unit
H8T opening-closing end in horizontal direction V81T opening-closing end of engagement-portion receiving portion
70 fastener tape
80 element
80H1 interlock portion
80H2 fastener-tape fixing portion
80V1 element engagement piece
80V2 element-engagement-piece receiving piece
80V1R element engagement portion
80V2R element-engagement-portion receiving portion
90 slider
90T slider body
90K tab

The invention claimed is:

1. A slide fastener comprising:

rows of elements arranged so as to face one another along edges of opening-closing ends of opposing fastener tapes; and a slider, wherein the slide fastener is to be interposed between a powered device on an output side and a power supply unit and a signal unit on an input side, the slide fastener forming an input-output line that activates the powered device with a closing operation of the slide fastener, wherein each of the elements includes: an interlock portion provided on a first side in a horizontal direction; a fastener-tape fixing portion provided on a second side in the horizontal direction; and an element-upper-leg portion and an element-lower-leg portion that extend in vertical upward and downward directions with respect to the horizontal direction, a portion of the element-upper-leg portion extended in the vertical upward direction being bent into a hook shape, and a portion of the element-lower-leg portion extended in the vertical downward direction being bent into a hook shape, and wherein the elements are arranged so as to face one another, the elements form a top holding section by bringing ends of the element-upper-leg portions arranged so as to face one another closer to or away from one another, and the elements form a bottom holding section by bringing ends of the element-lower-leg portions arranged so as to face one another closer to or away from one another in cooperation with interlock or separation of the interlock portions of the elements arranged so as to face one another, wherein, when the element-upper-leg portion and the element-lower-leg portion of the slide fastener are made of a nonelastic material, by sliding the slider along the elements arranged so as to face one another, the elements are interlocked to close opening-closing ends in the horizontal direction, which are the opposing fastener tapes, and an input electrode section or an output electrode section is concurrently engaged with the top holding section and the bottom holding section to close opening-closing ends in the vertical upward and downward directions, whereas when at least one of the element-upper-leg portion and the element-lower-leg portion of the slide fastener is made of an elastic material, by sliding the slider along the elements arranged so as to face one another, the elements are interlocked to close the opening-closing ends in the horizontal direction, which are the opposing fastener tapes, and the input electrode section or the output electrode section is concurrently engaged, or subsequently joined in a push-in manner, with the top holding section and the bottom holding section to close the opening-closing ends in the vertical upward and downward directions, and wherein a power and/or signal input-output line is formed by connecting a power supply input line and/or a signal input-output line to one of the opening-closing ends in the horizontal direction and the opening-closing ends in the vertical upward and downward directions or concurrently engaging, or subsequently joining in a push-in manner, the input electrode section to which the power supply input line and/or the signal input-output line is/are connected with the one of the opening-closing ends and by connecting a power supply output line extending to the powered device and/or a signal input-output line extending to the powered device to another one of the opening-closing ends or concurrently engaging, or subsequently joining in a push-in manner, the output electrode section to which the power supply output line extending to the powered device and/or the signal input-output line extending to the powered device is/are connected with the other one of the opening-closing ends.

2. The slide fastener according to claim 1, wherein each of electrodes electrically connected together inside the interlock portions or along surfaces of the interlock portions is embedded in either one of: the opposing fastener tapes; end portions of the element-upper-leg portions forming the top holding section; inner portions of the element-upper-leg portions; end portions of the element-lower-leg portions forming the bottom holding section; and inner portions of the element-lower-leg portions, the opposing fastener tapes, the end portions of the element-upper-leg portions, the inner portions of the element-upper-leg portions, the end portions of the element-lower-leg portions, and the inner portions of the element-lower-leg portions being opening-closing ends to which the power supply input line and/or the signal input-output line and the power supply output line extending to the powered device and/or the signal input-output line extending to the powered device are connected or with which the input electrode section to which the power supply input line and/or the signal input-output line is/are connected and the output electrode section to which the power supply output line extending to the powered device and/or the signal input-output line extending to the powered device is/are connected are concurrently engaged, or subsequently joined in a push-in manner, the opening-closing ends being chosen from among the opening-closing ends in the horizontal direction and the opening-closing ends in the vertical upward and downward directions.

3. The slide fastener according to claim 1, wherein the power and/or signal input-output line is stretchably provided along a ceiling in a building, a wall, an outer wall of a building, or a roadside tree or radially from a standing pole in such a manner as to stretch a rope.

4. A system forming an input-output line, comprising:

the slide fastener according to claim 1, the slide fastener having an output side and an input side, a powered device connected to the output side, a power supply unit connected to the input side, and a signal unit on an input side, wherein the system is configured to form the input-output line that activates the powered device with a closing operation of the slide fastener.

5. A slide fastener comprising:

a plurality of fastener units, each of which comprises:

rows of elements arranged so as to face one another along edges of opening-closing ends of opposing fastener tapes; and a slider, wherein the slide fastener is to be interposed between a powered device on an output side and a power supply unit and a signal unit on an input side, the slide fastener being connected to one or more slide fasteners and forming an input-output line that activates the powered device via a coupling electrode portion as a result of a closing operation of the slide fastener, an external input-output terminal being provided to the coupling electrode portion from a middle of a coupling portion, wherein each of the elements includes: an interlock portion provided on a first side in a horizontal direction; a fastener-tape fixing portion provided on a second side in the horizontal direction; and an element-upper-leg portion and an element-lower-leg portion that extend in vertical upward and downward directions with respect to the horizontal direction, a portion of the element-upper-leg portion extended in the vertical upward direction being bent into a hook shape, and a portion of the element-lower-leg portion extended in the vertical downward direction being formed into a hook shape, and wherein the elements are arranged so as to face one another and form a top holding section by bringing ends of the element-upper-leg portions arranged so as to face one another closer to or away from one another and to form a bottom holding section by bringing ends of the element-lower-leg portions arranged so as to face one another closer to or away from one another in cooperation with interlock or separation of the interlock portions of the elements arranged so as to face one another, wherein, by sliding the slider along the elements arranged so as to face one another, the elements are interlocked to close opening-closing ends in the horizontal direction, which are the opposing fastener tapes, and an input electrode section or an output electrode section is concurrently engaged with the top holding section and the bottom holding section to close opening-closing ends in the vertical upward and downward directions, wherein the plurality of fastener units include a fastener unit in which the element-upper-leg portion and the element-lower-leg portion are made of a nonelastic material and a fastener unit in which at least one of the element-upper-leg portion and the element-lower-leg portion is made of an elastic material, wherein, in a case of the fastener unit in which the element-upper-leg portion and the element-lower-leg portion are made of the nonelastic material among the plurality of fastener units, when the elements of each fastener unit arranged so as to face one another are interlocked by sliding the slider of the fastener unit along the elements of the fastener unit, a top holding section of a first one of the fastener units and a bottom holding section of a second one of the fastener units or a bottom holding section of the first fastener unit and a top holding section of the second one of the fastener units are coupled together using the coupling electrode portion and then a bottom holding section of a new fastener unit and a top holding section of a previous fastener unit or a top holding section of a new fastener unit and a bottom holding section of a previous fastener unit are sequentially coupled together using the coupling electrode portion, wherein, in a case of the fastener unit in which at least one of the element-upper-leg portion and the element-lower-leg portion is made of an elastic material among the plurality of fastener units, in a case where the other one of the element-upper-leg portion and the element-lower-leg portion is made of a nonelastic material, when the elements of each fastener unit arranged so as to face one another are interlocked by sliding the slider of the fastener unit along the elements of the fastener unit, the top holding section of the first fastener unit and the bottom holding section of the second one of the fastener units or the bottom holding section of the first fastener unit and the top holding section of the second one of the fastener units are coupled together using the coupling electrode portion and then a bottom holding section of a new fastener unit and a top holding section of a previous fastener unit or a top holding section of the new fastener unit and a bottom holding section of the previous fastener unit are sequentially coupled together using the coupling electrode portion, whereas in a case where the other one of the element-upper-leg portion and the element-lower-leg portion is made of an elastic material, when the elements of each fastener unit arranged so as to face one another are interlocked by sliding the slider of the fastener unit along the elements of the fastener unit, the top holding section of the first fastener unit and the bottom holding section of the second one of the fastener units or the bottom holding section of the first fastener unit and the top holding section of the second one of the fastener units are coupled together at the time of being engaged with the coupling electrode portion or subsequently in a push-in manner, and then a bottom holding section of a new fastener unit and a top holding section of a previous fastener unit or a top holding section of a new fastener unit and a bottom holding section of a previous fastener unit are coupled together at the time of being engaged with the coupling electrode portion or subsequently in a push-in manner, so that the plurality of fastener units are formed into a stacked structure, and wherein a power and/or signal input-output line is formed by connecting a power supply input line and/or a signal input-output line to one of the opening-closing ends in the horizontal direction of the plurality of fastener units formed into the stacked structure and the opening-closing ends in a vertical direction of an uppermost fastener unit and a lowermost fastener unit or engaging, or joining in a push-in manner, the input electrode section to which the power supply input line and/or the signal input-output line is/are connected with the one of the opening-closing ends and by connecting the power supply output line extending to the powered device and/or the signal input-output line extending to the powered device to another one of the opening-closing ends or engaging, or joining in a push-in manner, the output electrode section to which the power supply output line extending to the powered device and/or the signal input-output line extending to the powered device is/are connected with the other one of the opening-closing ends.

6. The slide fastener according to claim 5, wherein each of electrodes electrically connected together inside the interlock portions or along surfaces of the interlock portions is embedded in either one of: the opposing fastener tapes: end portions of the element-upper-leg portions forming the top holding section: inner portions of the element-upper-leg portions: end portions of the element-lower-leg portions forming the bottom holding section; and inner portions of the element-lower-leg portions, the opposing fastener tapes, the end portions of the element-upper-leg portions, the inner portions of the element-upper-leg portions, the end portions of the element-lower-leg portions, and the inner portions of the element-lower-leg portions being opening-closing ends to which the power supply input line and/or the signal input-output line and the power supply output line extending to the powered device and/or the signal input-output line extending to the powered device are connected or with which the input electrode section to which the power supply input line and/or the signal input-output line is/are connected and the output electrode section to which the power supply output line extending to the powered device and/or the signal input-output line extending to the powered device is/are connected are engaged, or subsequently joined in a push-in manner, the opening-closing ends being chosen from among the opening-closing ends in the horizontal direction of the plurality of fastener units formed into the stacked structure and the opening-closing ends in the vertical upward and downward directions of an uppermost fastener unit and a lowermost fastener unit.

7. The slide fastener according to claim 5, wherein the power and/or signal input-output line is stretchably provided along a ceiling in a building, a wall, an outer wall of a building, or a roadside tree or radially from a standing pole in such a manner as to stretch a rope.

8. A system forming an input-output line, comprising:

the slide fastener according to claim 5, the slide fastener having an output side and an input side, a powered device connected to the output side, a power supply unit connected to the input side, and a signal unit on an input side, wherein the system is configured to form the input-output line that activates the powered device with a closing operation of the slide fastener.

9. A slide fastener comprising:

rows of elements arranged so as to face one another along edges of opening-closing ends of opposing fastener tapes; and a slider, wherein the slide fastener is to be interposed between a powered device on an output side and a power supply unit and a signal unit on an input side, the slide fastener forming an input-output line that activates the powered device with a closing operation of the slide fastener, wherein each of the elements includes: an interlock portion provided on a first side in a horizontal direction; a fastener-tape fixing portion provided on a second side in the horizontal direction; and an element-leg portion that extends in one vertical direction with respect to the horizontal direction, an extended portion of the element-leg portion being bent into a hook shape, and wherein the elements are arranged so as to face one another and form a holding section by bringing ends of the element-leg portions arranged so as to face one another closer to or away from one another in cooperation with interlock or separation of the interlock portions of the elements arranged so as to face one another, wherein, when the element-leg portion of the slide fastener is made of a nonelastic material, by sliding the slider along the elements arranged so as to face one another, the elements are interlocked to close opening-closing ends in the horizontal direction, which are opposing fastener tapes, and an input electrode section or an output electrode section is concurrently engaged with the holding section to close the opening-closing end in the one vertical direction, whereas when the element-leg portion of the slide fastener is made of an elastic material, by sliding the slider along the elements arranged so as to face one another, the elements are interlocked to close the opening-closing ends in the horizontal direction, which are the opposing fastener tapes, and the input electrode section or the output electrode section is concurrently engaged, or subsequently joined in a push-in manner, with the holding section to close the opening-closing end in the one vertical direction and wherein a power and/or signal input-output line is formed by connecting a power supply input line and/or a signal input-output line to one of the opening-closing ends in the horizontal direction and the opening-closing end in the one vertical direction or concurrently engaging, or subsequently joining in a push-in manner, the input electrode section to which the power supply input line and/or the signal input-output line is/are connected with the one of the opening-closing ends and by connecting a power supply output line extending to the powered device and/or a signal input-output line extending to the powered device to another one of the opening-closing ends or concurrently engaging, or subsequently joining in a push-in manner, the output electrode section to which the power supply output line extending to the powered device and/or the signal input-output line extending to the powered device is/are connected with the other one of the opening-closing ends.

10. The slide fastener according claim 9, wherein each of electrodes electrically connected together inside the interlock portions or along surfaces of the interlock portions is embedded in either one of: the opposing fastener tapes; end portions of the element-leg portions forming the holding section; and inner portions of the element-leg portions, the opposing fastener tapes, the end portions of the element-leg portions, and the inner portions of the element-leg portions being opening-closing ends to which the power supply input line and/or the signal input-output line and the power supply output line extending to the powered device and/or the signal input-output line extending to the powered device are connected or with which the input electrode section to which the power supply input line and/or the signal input-output line is/are connected and the output electrode section to which the power supply output line extending to the powered device and/or the signal input-output line extending to the powered device is/are connected are concurrently engaged, or subsequently joined in a push-in manner.

11. The slide fastener according to claim 9, wherein the power and/or signal input-output line is stretchably provided along a ceiling in a building, a wall, an outer wall of a building, or a roadside tree or radially from a standing pole in such a manner as to stretch a rope.

12. A system forming an input-output line, comprising:

the slide fastener according to claim 9, the slide fastener having an output side and an input side, a powered device connected to the output side, a power supply unit connected to the input side, and a signal unit on an input side, wherein the system is configured to form the input-output line that activates the powered device with a closing operation of the slide fastener.

13. A slide fastener comprising:

two fastener units, each of which comprises:

rows of elements arranged so as to face one another along edges of opening-closing ends of opposing fastener tapes; and a slider, wherein the slide fastener is to be interposed between a powered device on an output side and a power supply unit and a signal unit on an input side, the slide fastener being connected to one or more slide fasteners and forming an input-output line that activates the powered device via a coupling electrode portion as a result of a closing operation of the slide fastener, an external input-output terminal being provided to the coupling electrode portion from a middle of a coupling portion, wherein each of the elements includes: an interlock portion provided on a first side in a horizontal direction; a fastener-tape fixing portion provided on a second side in the horizontal direction; and an element-leg portion that extends in one vertical direction with respect to the horizontal direction, an extended portion of the element-leg portion being bent into a hook shape, and wherein the elements are arranged so as to face one another and form a holding section by bringing ends of the element-leg portions arranged so as to face one another closer to or away from one another in cooperation with interlock or separation of the interlock portions of the elements arranged so as to face one another, wherein, by sliding the slider along the elements arranged so as to face one another, the elements are interlocked to close opening-closing ends in the horizontal direction, which are the opposing fastener tapes, and an input electrode section or an output electrode section is concurrently engaged with the holding section to close an opening-closing end in the one vertical direction, wherein the two fastener units include a fastener unit in which the element-leg portion is made of a nonelastic material and a fastener unit in which the element-leg portion is made of an elastic material, wherein, in a case where the two fastener units each include an element-leg portion made of a nonelastic material, when the elements of the two fastener units arranged so as to face one another are interlocked by sliding the sliders of the two fastener units along the elements of the fastener units, the holding sections of the two fastener units are coupled together in a vertical direction using the coupling electrode portion, wherein, in a case where at least a first one of the two fastener units includes the element-leg portion made of an elastic material, in a case where a second one of the two fastener units includes the element-leg portion made of a nonelastic material, when the elements of the fastener unit including the element-leg portion made of a nonelastic material are interlocked by sliding the slider of the fastener unit along the elements of the fastener unit arranged so as to face one another, the holding sections of the fastener units are coupled together in the vertical direction using the coupling electrode portion and then, when the elements of the fastener unit including the element-leg portion made of an elastic material are interlocked, the holding portions are concurrently coupled together using the coupling electrode portion or subsequently coupled together in the vertical direction in a push-in manner, whereas in a case where the second one of the fastener units includes an element-leg portion made of an elastic material, when the elements of the two fastener units arranged so as to face one another are interlocked by sliding the sliders of the two fastener units along the elements of the fastener units, the holding sections of the fastener units each including the element-leg portion made of an elastic material are coupled together using the coupling electrode portion or coupled together in the vertical direction in a push-in manner after the elements have been interlocked, so that the two fastener units are formed into a stacked structure, and wherein a power and/or signal input-output line is formed by connecting a power supply input line and/or a signal input-output line to the opening-closing ends in the horizontal direction of the first one of the two fastener units formed into the stacked structure and connecting the power supply output line extending to the powered device and/or the signal input-output line extending to the powered device to the opening-closing ends in the horizontal direction of the second one of the fastener units.

14. The slide fastener according to claim 13, wherein each of electrodes electrically connected together inside the interlock portions or along surfaces of the interlock portions is embedded in either one of: the opposing fastener tapes; end portions of the element-leg portions forming the holding sections coupled together in the vertical direction using the coupling electrode portion or coupled together in a push-in manner; and inner portions of the element-leg portions, the power supply input line and/or the signal input-output line or the power supply output line extending to the powered device and/or the signal input-output line extending to the powered device being connected to the opposing fastener tapes, the end portions of the element-leg portions, and the inner portions of the element-leg portions.

15. The slide fastener according to claim 13, wherein the power and/or signal input-output line is stretchably provided along a ceiling in a building, a wall, an outer wall of a building, or a roadside tree or radially from a standing pole in such a manner as to stretch a rope.

16. A system forming an input-output line, comprising:

the slide fastener according to claim 13, the slide fastener having an output side and an input side, a powered device connected to the output side, a power supply unit connected to the input side, and a signal unit on an input side, wherein the system is configured to form the input-output line that activates the powered device with a closing operation of the slide fastener.

17. A slide fastener comprising:

a plurality of fastener units, each of which comprises:

rows of elements arranged so as to face one another along edges of opening-closing ends of opposing fastener tapes; and a slider, wherein the slide fastener is to be interposed between a powered device on an output side and a power supply unit and a signal unit on an input side, the slide fastener forming an input-output line that activates the powered device with a closing operation of the slide fastener, wherein each of the elements includes: an interlock portion provided on a first side in a horizontal direction; a fastener-tape fixing portion provided on a second side in the horizontal direction; and an engagement piece and an engagement-piece receiving piece that extend in vertical upward and downward directions with respect to the horizontal direction, a portion of the engagement piece extending in the vertical upward direction being formed into an arrow-head shape, and a portion of the engagement-piece receiving piece extending in the vertical downward direction being bent into a hook shape, and wherein the elements are arranged so as to face one another so that engagement pieces of the elements arranged so as to face one another form engagement portions and engagement-piece receiving pieces of the elements arranged so as to face one another form engagement-portion receiving portions in cooperation with interlock or separation of the interlock portions of the elements arranged so as to face one another, wherein, by sliding the slider along the elements arranged so as to face one another, the elements are interlocked to close opening-closing ends in the horizontal direction, which are the opposing fastener tapes, and concurrently close an opening-closing end of the engagement-portion receiving portion extending downward, wherein in a case where the plurality of fastener units include a fastener unit that includes an engagement-piece receiving piece extending downward and made of a nonelastic material and a fastener unit that includes an engagement-piece receiving piece extending downward and made of an elastic material and the fastener unit of the plurality of fastener units including the engagement-piece receiving piece made of the nonelastic material is connected to other fastener units in a stacked manner, the plurality of fastener units are formed into a stacked structure by engaging, when the elements of each fastener unit are interlocked by sliding the slider of the fastener unit along the elements of the fastener unit, an engagement portion of a first one of the fastener units in which the interlock portions have been interlocked with an engagement-portion receiving portion of a second one of the fastener units made of a nonelastic material and by sequentially engaging an engagement portion of a previous fastener unit with an engagement-portion receiving portion of a new fastener unit, whereas in a case where the fastener unit including the engagement-piece receiving piece made of an elastic material is connected to other fastener units in a stacked manner, the plurality of fastener units are formed into the stacked structure by engaging, when the elements of each fastener unit are interlocked by sliding the slider of the fastener unit along the elements of the fastener unit, an engagement portion of a first one of the fastener units in which the interlock portions have been interlocked with an engagement-portion receiving portion of a second one of the fastener units made of an elastic material and concurrently engaging, or subsequently joining in a push-in manner, an engagement portion of a previous fastener unit with an engagement-portion receiving portion of a new fastener unit, and wherein a power and/or signal input-output line is formed by connecting a power supply input line and/or a signal input-output line to one of the opening-closing ends in the horizontal direction of the plurality of fastener units formed into the stacked structure and the opening-closing ends of an engagement-portion receiving portion of a lowermost fastener unit or engaging, or joining in a push-in manner, the input electrode section to which the power supply input line and/or the signal input-output line is/are connected with the one of the opening-closing ends and by connecting the power supply output line extending to the powered device and/or the signal input-output line extending to the powered device to another one of the opening-closing ends or engaging, or joining in a push-in manner, the output electrode section to which the power supply output line extending to the powered device and/or the signal input-output line extending to the powered device is/are connected with the other one of the opening-closing ends.

18. The slide fastener according to claim 17, wherein each of electrodes electrically connected together inside the interlock portions or along surfaces of the interlock portions is embedded in either one of: the opposing fastener tapes; and the engagement pieces and the engagement-piece receiving pieces connected in a stacked manner among the engagement pieces and the engagement-piece receiving pieces of the plurality of fastener units formed into the stacked structure, the opposing fastener tapes and the connected engagement pieces and engagement-piece receiving pieces being opening-closing ends to which the power supply input line and/or the signal input-output line or the power supply output line extending to the powered device and/or the signal input-output line extending to the powered device is/are connected, the opening-closing ends being chosen from among the opening-closing ends in the horizontal direction of the plurality of fastener units formed into the stacked structure.

19. The slide fastener according to claim 17, wherein the power and/or signal input-output line is stretchably provided along a ceiling in a building, a wall, an outer wall of a building, or a roadside tree or radially from a standing pole in such a manner as to stretch a rope.

20. A system forming an input-output line, comprising:

the slide fastener according to claim 17, the slide fastener having an output side and an input side, a powered device connected to the output side, a power supply unit connected to the input side, and a signal unit on an input side, wherein the system is configured to form the input-output line that activates the powered device with a closing operation of the slide fastener.

* * * * *